US007499855B2

(12) United States Patent
Schweng

(10) Patent No.: US 7,499,855 B2
(45) Date of Patent: Mar. 3, 2009

(54) DELAY FREE NOISE SUPPRESSION

(75) Inventor: Detlef Schweng, Weinstadt-Schnait (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 730 days.

(21) Appl. No.: 10/830,354

(22) Filed: Apr. 22, 2004

(65) Prior Publication Data

US 2005/0228660 A1 Oct. 13, 2005

(30) Foreign Application Priority Data

Mar. 30, 2004 (EP) ..... 04392012

(51) Int. Cl.
*G10L 19/00* (2006.01)

(52) U.S. Cl. ..... 704/226

(58) Field of Classification Search ..... 704/226
See application file for complete search history.

(56) References Cited

U.S. PATENT DOCUMENTS 6,208,951 B1 3/2001 Kumar et al. ..... 702/191
6,502,067 B1 12/2002 Hegger et al. ..... 704/216

FOREIGN PATENT DOCUMENTS

CA 2319995 9/2000
EP 091349 A 4/2001

OTHER PUBLICATIONS

Ph.D thesis of Hyoung-Gook Kim, "Background Noise Reduction Based on Diffusive Gain Factors and 1.2 kbit/s Low Bit Rate Speech Coding Using Spectral Vector Quantization of Differential Features, Technische Universitat Berlin, Faćhbereich Elektrotechnik und Informatik, Berlin, 2002, 083."

"Low-complexity Digital Filter Structures and Characteristics Using Orthogonal Transforms," by Agbinya et al., Singapore ICCS '94, 1994 IEEE, pp. 825-829.

"The Running Bispectrum," by Thatcher et al., pp. 36-40.

"Real-time Noise Cancelling Based on Spectral Minimum Detection and Diffusive Gain Factors", by Kim et al., 8th Aust. Int. Conf., Speech Sci & Tech., XP-001013195, pp. 250-255.

*Primary Examiner*—Susan McFadden
(74) *Attorney, Agent, or Firm*—Saile Ackerman LLC; Stephen B. Ackerman

(57) ABSTRACT

An apparatus, a circuit and a method are given, to realize very effective noise suppression for speech signals. Using thereby novel calculation methods allow for a real-time operation without any remarkable delay. Also a significant reduction of the overall processing power demands in conjunction with reduced memory requirements is achieved. Using the intrinsic advantages of that solution the circuit of the invention is manufactured with standard CMOS technology and/or standard Digital Signal Processors at low cost.

32 Claims, 13 Drawing Sheets

FIG. 1A – Prior Art

*Provide a means for a "Sample-Wise Discrete Cosine Transformation", wherein according to the "Theory of the Sample-Wise Discrete Cosine Transformation (DCT)" a continuous stream of sound samples x(n) is transformed into the Fourier spectrum X, represented by M frequency bands X(0)...X(M-1) for every sample and wherein the Formulas (A) and (B) - as given and defined in the following two steps - are used for the transformation of x(n) into X(0)...X(M-1); X thereby split into its real and its imaginary parts Xreal and Ximag; thereby n being the running counter index of the continuous input stream of sound samples and M the number of frequency bands observed* — 710

↓

*Transform within said means for a "Sample-Wise Discrete Cosine Transformation" sound sample x(n) into the real parts of the Fourier spectra X(0)...X(M-1) using as Formula (Re) for the transformation the following recursive Equation (Re)*

Re: $S_{dreal,n}(k)=S_{dreal,n-1}(k)+(s_{dreal}(n)-s_{dreal}(n-M))\cos(2\pi nk/M)$ — 715

*where, in the mathematical expression-the variables s & S - generic for signal - have to be replaced by x & X as used here and already defined above, whereby d denotes the application of a discrete Fourier transform algorithm with k as its frequency number or index representing the discrete resulting frequency lines for the frequency band observed*

↓

*Transform within said means for a "Sample-Wise Discrete Cosine Transformation" sound sample x(n) into the imaginary parts of the Fourier spectra X(0)...X(M-1) using as Formula (Im) for the transformation the following recursive Equation (Im)*

Im: $S_{dimag,n}(k)=S_{dimag,n-1}(k)+(s_{dreal}(n-M)-s_{dreal}(n))\sin(2\pi nk/M)$ — 717

*where, in the mathematical expression-the variables s & S - generic for signal - have to be replaced by x & X as used here and already defined above, whereby d denotes the application of a discrete Fourier transform algorithm with k as its frequency number or index representing the discrete resulting frequency lines for the frequency band observed*

→ ©

FIG. 6A

DELAY FREE NOISE SUPPRESSION

BACKGROUND OF THE INVENTION (1) Field of the Invention

The invention relates generally to electronic circuits for telecommunications and to methods used therewith and more particularly, to a circuit for transmission of sound signals and to a method for speech transmission with noise suppression. The invention also concerns an apparatus for implementing the method and use thereof.

(2) Description of the Prior Art

In telecommunications and recording techniques of sound signals a major problem is the degradation of the transmitted or recorded sound signals by ambient noise. When it comes to speech transmission or recording the intelligibility of the transmitted or recorded speech signal in the presence of audible noise is most important. This is especially very obvious and significant in the case where car drivers are communicating on telephone during ride with the aid of hands-free phone equipment. In order to generally suppress or reduce audible ambient noise of such sound signals a multitude of techniques and methods has been specified in the past.

The main problem hereby is due to the fact, that in most cases the unwanted noise signal and the wanted sound signal are most likely to appear within the same frequency range. Such they have to be discriminated by other characteristics than their frequency range. Albeit filtering techniques in the frequency domain have been vastly used in prior art, yet with unsatisfactory results. Other discrimination characteristics, both in the frequency and in the time domain have been under scrutiny in many different prior art approaches and have proved to deliver more satisfying results. Modern digital integrated signal processing circuits either built up with discrete computational units or in the form of monolithic digital signal processors allow for an extensive use of advanced calculation algorithms such as the Fast/Discrete Fourier Transformation (FFT/DFT) or Correlation Analysis (CA) methods. The computational demands hereby are however very high and are often not suitable for real-time applications. In case where real-time requirements have to be met, practical realizations lead to very costly solutions.

FIG. 1A prior art depicts the normally used method for the processing in such digital integrated signal processing circuits, whereby in block 15 the Fast Fourier Transformation (FFT) processing is taking place, namely for all the M samples of an incoming noisy signal x(n) during one sampling period, giving M FFT values X(n,k), whereby n may be called a 'discrete time variable' for x(n) and k named as a 'normalized frequency number or index' in case of X(n,k). These M results X(n,k) 35 are then carried altogether in parallel into the Noise Reduction Processing Unit 55 for their further processing to achieve the desired "noise free" resulting signal s(n), whereby the calculations for all frequency numbers are done all at once, which is very time consuming and thus causing considerable delay for the processing of a whole data set due to the many calculations needed. As can also be seen substantial computing power in blocks 15 and 55 is needed for all these necessary calculations.

It is therefore a challenge for the designer of such methods and circuits to achieve a high-quality and low-cost solution. Several prior art inventions referring to such solutions describe related technologies, methods and circuits.

U.S. Pat. No. 6,208,951 (to Kumar et al.) describes a method and an apparatus for the identification and/or separation of complex composite signals into its deterministic and noisy components with a given process for the identification and/or separation of composite signal into its deterministic and noisy components wherein the process uses recursive wavelet transformations to separate the deterministic and noisy components of signals and uses the difference in the properties with regard to degree of correlation and dimensionality of these constituent components as a basis for separation, the said process of identification and/or separation has application in a variety of situations where digitized data is made available via an apparatus which converts the monitored signals.

U.S. Pat. No. 6,502,067 (to Hegger et al.) discloses a method and apparatus for processing noisy sound signals including a method for processing a sound signal y in which redundancy, consisting mainly of almost repetitions of signal profiles, is detected and correlations between the signal profiles are determined within segments of the sound signal. Correlated signal components are allocated to a power component and uncorrelated signal components to a noise component of the sound signal. The correlations between the signal profiles are determined by methods of nonlinear noise reduction in deterministic systems in reconstructed vector spaces based on the time domain.

Canadian Patent CA 02319995 (to Ruwisch) discloses a method and apparatus for suppressing audible noise in speech transmission by means of a multi-layer self-organizing feedback neural network. This method involves using a multi-layer self-organising neural network with feedback. A minima detection layer, a reaction layer, a diffusion layer and an integration layer define a filter function (F(f,T)) for noise filtering. The filter function is used to convert a spectrum B(f, T) free of noise, into a noise-free speech signal (y(t)) by inverse Fourier transformation. The signal delay caused by processing the signal is so short that the filter can operate in real-time for telecommunication. All neurons are supplied with an externally set parameter K, the size of which defines the degree of noise suppression of the whole filter. An Independent claim is included for an apparatus for noise suppression during speech transmission.

The Ph.D. thesis of Hyoung-Gook Kim, "Background Noise Reduction Based on Diffusive Gain Factors and 1.2 kbit/s Low Bit Rate Speech Coding Using Spectral Vector Quantization of Differential Features, Technische Universität Berlin, Fachbereich Elektrotechnik und Informatik, Berlin 2002, D83" describes a novel method which uses a background noise reduction with the help of a minimum detection stage, a stage for the estimation of the noise and a computation stage based on Diffusive Gain Factors (DGF). The circuit developed for this method has however a rather high demand for processing power.

Although these papers describe methods close to the field of the invention they differ in essential features from the method and especially the circuit introduced here.

SUMMARY OF THE INVENTION

A principal object of the present invention is to provide an effective method implementable with the help of very manufacturable integrated circuits for a noise suppressing system for sound signals.

An object of the present invention is thereby to establish an especially adapted method for sound signals containing human speech.

Also an object of the present invention is thereby to include into said adapted method for speech signals a means to avoid unwanted artifacts, e.g. "musical tones".

A further object of the present invention is to allow for an implementation with modern digital signal processors by use of the appropriate design features of said method.

Also an object of this invention is to reduce the necessary processing time by use of sophisticated algorithms for the noise suppression, thus rendering the circuit capable for real-time operations.

Equally an object of this invention is to reduce the necessary processing time to such an extent, that the operation of the circuit can be called delay-free under real-time conditions.

Another important object of the present invention is to reduce the overall processing power demands in conjunction with reduced memory requirements by exploiting the inherent design features relating to a set of M incoming data samples x(n), their according spectra X(k) calculated with the help of a Discrete Fourier Transform (DFT) algorithm and the use of Noise Gain Factors (NGF), whereby only one NGF out of a set of M NGFs is processed, selected via an 'n modulo M' rule where M is a power of 2 (as required by the DFT algorithm) and relating to selecting each frequency number k at least once within said set of M incoming data samples x(n) and thus allowing to economically process a noise free set of M output signal values s(n) without any significant delay.

A still further object of the present invention is to reduce the power consumption of the circuit by realizing inherent appropriate design features.

Another further object of the present invention is to reduce the cost of manufacturing by implementing the circuit as a monolithic integrated circuit in low cost CMOS technology.

Another still further object of the present invention is to reduce cost by effectively minimizing the number of expensive components.

In accordance with the objects of this invention, a method is achieved, describing in detailed steps an algorithm and its implementation units for a 'Delay Free Noise Suppression', capable of generating a noise reduced—'noise free'—output sound signal out of a noise polluted input sound signal, where said method steps are dealing with signals, both time signals and sampled signals, their corresponding spectrum data words and the essential Noise Gain Factor (NGF) values, and are further dealing with the respective output spectrum data, as provided by the algorithm of said method. Said method is then delivering the desired noise canceled output signal. Said method therefore comprises steps for preparing the processing of received noisy speech input signals—from an A/D converter—representing a series of digitized words of sound sample data in form of an input data stream; receiving a data stream of sound samples for an according, consecutively described "Sample-Wise Discrete Fourier Transformation" calculation step; further a step for calculating the spectrum of said sound samples, exemplified for a single sample and performed in a "Sample-Wise Discrete Cosine Transformation" unit, resulting in parallel data words, describing the spectrum of said sound sample and therein optionally performing a Hann windowing in the frequency domain i.e. on the data words of the spectra; also further steps for delivering said spectrum data words via a "Multiplexer" unit in parallel into "Multipliers", part of a "Noise Canceling Multiplier" unit, and clocking serially in a data stream of said spectra into a "Minimum Detection" unit and processing said serial spectrum data words in order to evaluate the minimum value for that signal sample; then feeding said minimum spectrum value into a "Noise Gain Factor Calculation" unit and receiving said input values in said "Noise Gain Factor Calculation" unit, which possesses a total of four inputs: input #1 for said minimum spectrum value, input #2 for a Filter Strength value, separately evaluated and furnished, input #3 for an average Noise Gain Factor (NGF) value furnished from an "Average Calculation" unit, and input #4 for a series of previous NGF values, clocked in from a "Noise Canceling Multiplier Table" unit, part of said "Noise Canceling Multiplier" unit. Also included are steps for calculating in said "Noise Gain Factor Calculation" unit out of the four input signals a new series of NGF values and feeding said new series of NGF values via a "Synchronous Signal Detection" unit into said "Noise Canceling Multiplier Table" unit of said "Noise Canceling Multiplier" unit as well as feeding said new series of NGF values into said "Average Calculation" unit as input values, and switching said new series of NGF values through to said "Noise Canceling Multiplier Table" unit as multiplication factors into said "Multipliers" of said "Noise Canceling Multiplier" unit. Comprised is further the multiplication of said new series of NGF values with said according spectrum data words of said noisy speech input signal and thus generating with said multiplication process of said spectrum data words with said NGF values a new set of noise canceled data values, which are then reversely transformed within said "Inverse Sample-Wise Discrete Cosine Transformation" unit into a noise canceled speech signal. Also included is the transmission of said noise free speech output signals, represented as a series of digitized words of sound sample data into a D/A converter for the final conversion into the desired noise free speech signal.

Also in accordance with the objects of this invention, an apparatus, implementing a new method is achieved, realizing a modern digital system for a 'Delay Free Noise Suppression' operating on analog input signals and delivering analog output signals, hereby digitally processing sound signals or—more specific—speech signals, thereby using a means specialized to realize a noise suppression method essentially based upon "Sample-Wise Discrete Cosine Transformation (DCT) and Spectral Minimum Detection (SMD) with Noise Gain Factors (NGF)" algorithms. An apparatus comprising a first circuit block, wherein the analog input signal—representing the noise polluted speech signals continuously converted into a digital input data stream of noisy sound samples; a second circuit block containing a digital signal processing system processing said digital data stream x(n) of noisy sound samples using said method for the 'delay free' noise suppression or cancelation for speech signals with "Sample-Wise Discrete Cosine Transformation (DCT) and Spectral Minimum Detection (SMD) with Noise Gain Factors (NGF)" algorithms essentially consisting of three parts: first a "Sample-Wise Discrete Cosine Transformation" part and second the "Spectral Minimum Detection (SMD) with Noise Gain Factors (NGF)" part and third an "Inverse Sample-Wise Discrete Cosine Transformation" part; and a third circuit block reconverting said processed digital output data stream s(n) of noise free sound samples—representing the noise canceled sound signal—back into said analog output signal, which is the desired noise canceled speech signal.

Furthermore in accordance with the objects of this invention, a circuit is achieved, implementing the new method of the invention, a circuit realizing within a modern digital system for a 'Delay Free Noise Suppression' a noise suppression method essentially based upon "Sample-Wise Discrete Cosine Transformation (DCT) and Spectral Minimum Detection (SMD) with Noise Gain Factors (NGF)" algorithms, hereby digitally processing sound signals or more specific, speech signals—where the noisy speech input signal is represented as a series of continuously digitized words of sound sample data, a data stream ready for being processed by said circuit. Said circuit comprises a circuit block, named "Sample-Wise Discrete Cosine Transformation" unit, possessing one serial data input line and a set of parallel data output lines, receiving said data stream of sound samples—on said serial data input line—for the according "Sample-Wise Discrete Cosine Transformation (DCT)" calculation step of said algorithm, resulting in data words, describing the spectrum of that sound sample; it comprises also a circuit block, named "Digital Signal Processing (DSP) System for Noise Suppression with Spectral Minimum Detection (SMD) with Noise Gain Factors (NGF)" consisting of a digital signal processor system implementing a noise suppression algorithm, whereby said incoming data stream of spectrum data words is transformed into the desired noise canceled outgoing data stream of output data words for the 'noise free' spectra, whereto Noise Gain Factors (NGF) are calculated according to an estimation rule for the noise floor, as evaluated with the help of said Spectral Minimum Detection (SMD) algorithm and an added Filter Strength factor with values between 0.0 (no filtering at all) and 1.0 (maximum filter strength) accounts for deviations from a standard rule i.e. sudden changes of said noise floor e.g. and where said Filter Strength value can be chosen as a constant or can be dynamically varied by using a nonlinear function between the filter strength and the averaged Noise Gain Factors. Furthermore comprised is a circuit block, named "Inverse Sample-Wise Discrete Cosine Transformation" unit, which reversely transforms said noise canceled output spectrum data values back into the noise canceled speech signal, possessing a set of parallel data input lines and a serial data output line for delivering said noise canceled speech signal.

Finally in accordance with the objects of this invention, a circuit is achieved, also implementing the new method of the invention, a circuit realizing within a modern digital system for a 'Delay Free Noise Suppression' a noise suppression method essentially based upon "Sample-Wise Discrete Cosine Transformation (DCT) and Spectral Minimum Detection (SMD) with Noise Gain Factors (NGF)" algorithms, hereby digitally processing sound signals or more specific, speech signals—where the noisy speech input signal is represented as a series of continuously digitized words of sound sample data, a data stream ready for being processed by said circuit. Said circuit comprises a first circuit block, named "Sample-Wise Discrete Cosine Transformation" unit, possessing one serial data input line and a set of M parallel data output lines, receiving said data stream of sound samples—on said serial data input line—for the according "Sample-Wise Discrete Cosine Transformation (DCT)" calculation step of said algorithm, resulting in a set of data words, describing the spectrum of that sound sample. Said circuit also comprises several other circuit blocks, one named "Multiplexer" unit, possessing a set of parallel data input lines and another set of parallel data output lines and also one serial data output line, whereby said set of parallel data input lines connects to said "Sample-Wise Discrete Cosine Transformation" unit, and said set of parallel data output lines connects to a consecutively defined set of "Multipliers", and said serial data output line connects to a consecutively defined "Minimum Detection" unit; another circuit block named "Noise Canceling Multiplier" unit, consisting of a set of "Multipliers" and a "Noise Canceling Multiplier (NCM) Table" and serving as the central processing block for said algorithm thereby calculating the desired noise canceled output spectrum data values with the help of said consecutively evaluated Noise Gain Factor (NGF) values, possessing a set of parallel data input lines and a set of parallel data output lines as well as one serial data input line and one serial data output line, whereby said set of parallel data input lines connects to said "Multiplexer" unit and said set of parallel data output lines connects to a consecutively defined "Inverse Sample-Wise Discrete Cosine Transformation" unit, and whereby said one serial data input line connects to a consecutively defined "Synchronous Signal Detection" unit and said serial data output line connects to a consecutively defined "Noise Gain Factor Calculation" unit; one more circuit block, named "Minimum Detection" unit, possessing a serial data input line and a serial data output line, whereby said serial data input line connects to said "Multiplexer" unit and said serial data output line connects to said "Noise Gain Factor Calculation" unit; and another circuit block, named "Noise Gain Factor Calculation" unit, essentially responsible for the calculations for said Noise Gain Factor (NGF) values, possessing a total of four serial data input lines and one serial data output line, whereby the first serial data input line connects to said "Noise Canceling Multiplier" unit, and the second serial data input line connects to said "Minimum Detection" unit, and the third serial data input line connects to a consecutively defined "Average Calculation" unit, and the fourth serial data input line connects to an optional and separately furnished Filter Strength value signal and whereby said serial data output line connects to said "Synchronous Signal Detection" unit; furthermore a circuit block, named "Average Calculation" unit, possessing a serial data input line and a serial data output line whereby said serial data input line connects to said "Synchronous Signal Detection" unit and said serial data output line connects to said "Noise Gain Factor Calculation" unit; also another circuit block, named "Synchronous Signal Detection" unit, possessing a serial data input line and a serial data output line whereby said serial data input line connects to said "Noise Gain Factor Calculation" unit and said serial data output line connects to said "Average Calculation" unit as well as said "Noise Canceling Multiplier" unit; and finally a circuit block, named "Inverse Sample-Wise Discrete Cosine Transformation" unit, which reversely transforms said noise canceled output spectrum data values back into the noise canceled speech signal, possessing a set of parallel data input lines and a serial data output line for delivering said noise canceled speech signal.

BRIEF DESCRIPTION OF THE DRAWINGS

In the accompanying drawings forming a material part of this description, the details of the invention are shown:

FIG. 1A prior art and FIG. 1B illustrate the significant difference in the operation of the essential circuit blocks between prior art realizations and an embodiment for the present invention.

FIG. 6A-6F show in form of a flow diagram the method implemented with the electrical circuit as shown in FIG. 2.

DESCRIPTION OF THE PREFERRED EMBODIMENTS

Figure 1B:
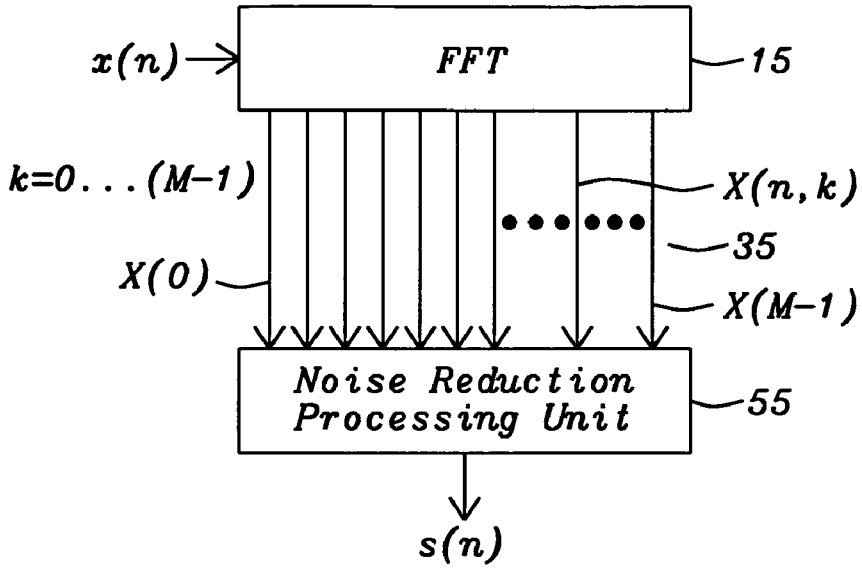
Figure 1B:
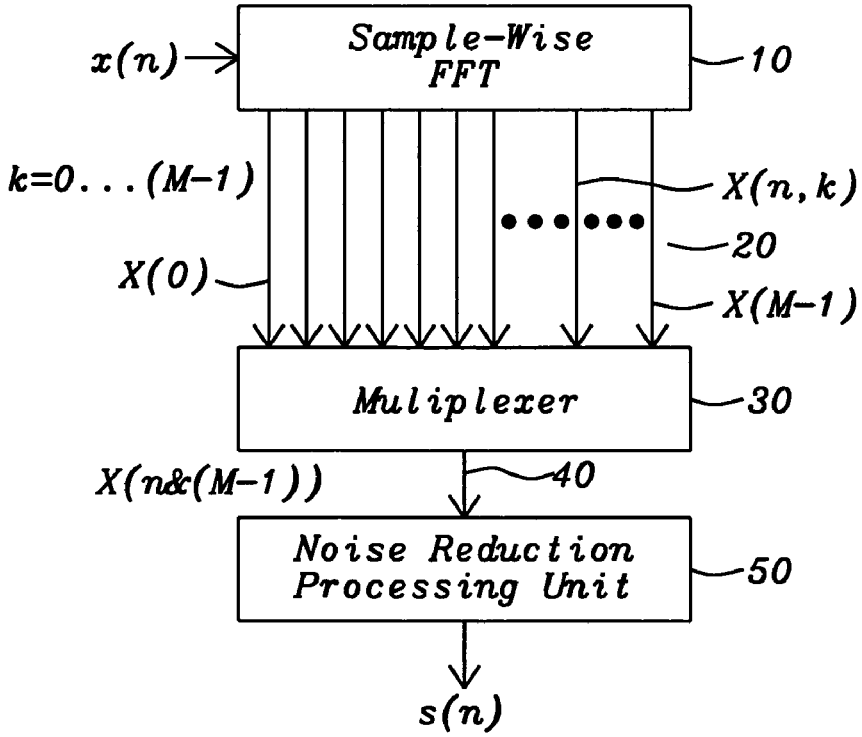

The preferred embodiments disclose a novel method for an implementation of a real-time noise-suppressing algorithm using modern integrated digital circuits and an exemplary circuit thereto.

The description of the preferred embodiments of the invention is subdivided into two steps; first an overall description of the whole implementation and its constitutive method is given and second a more detailed description of the underlying theory is presented, whereon said method is based upon.

The approach followed here is to some extent already known as a method based on spectral subtraction and described elsewhere in the pertinent literature. It is a simple but very effective psychoacoustically motivated real-time approach essentially based upon a one-channel noise reduction with spectral subtraction technique and as such apt to achieve a well-balanced trade-off between noise reduction and speech distortion. The new method is derived from a concept called more precisely "Spectral Minimum Detection (SMD) with Diffusive Gain Factors (DGF)". The invention claimed here consists in a simpler and more effective algorithm, using a sample-wise applied Discrete Fourier Transformation (DFT) with simplified calculation formulas and thus making possible a real-time implementation with virtually no delays. Furthermore the method for calculating the DGF is varied and optimized as a new calculation method for Noise Gain Factors (NGF), perfectly fitting into the sample-wise DFT processing scheme.

As a comprehension aid the following list is compiled and presented here, and so consequently showing the variables in order of their logical appearance within the various descriptions. An introductory remark shall be made concerning sampled digital signals $S_d$ (n), where n is the current running index or counter of the sample and also concerning its assigned frequency spectrum $S_d$ (n, k), obtained by applying a Discrete FOURIER Transformation or DFT-algorithm, thus giving k discrete resulting frequency lines; the subscript d alluding formally to the application of a discrete Fourier transform algorithm with frequency number k used as its current summation index and the number M defining the number of samples necessary for the DFT calculation, and required to be a power of 2.

LIST OF REFERENCES FOR THE VARIABLES USED WITH EXPLANATIONS x(t) continuous and analog noisy input signal t time x(n) continuous stream of sound samples with current index n n discrete time variable as running or counting index in case of x(n)

k (normalized) frequency number as running index in case of X(n) which physically spoken is not a frequency itself, but a number representing a frequency X(n) complex DFT-spectrum represented simplified as frequency band for data sample x(n) with current index n X(n,k) complex DFT-spectrum represented as frequency band for data sample x(n) with current discrete time variable as index n and frequency number k as index k $X_{real}$ real part of amplitude value for X(n)

$X_{imag}$ imaginary part of amplitude value for X(n)

M number of frequency bands in data set, necessarily a power of 2-by reason of FFT/DFT algorithm—and its value depending on frequency range, time frame, sampling rate and desired resolution X(0) to X(M-1) set of M frequency bands, named as single data items X(n&(M-1)) selected data sample out of the data set of M frequency bands, assigned to sample x(n) via an 'n modulo M' rule, M being a power of 2

$X_{min}$(n) absolute minimum of amplitude values for data set X(M)

$X_{min}$(n&(M-1)) selected data sample out of the data set representation thereof N(0) . . . N(M-1) Noise Gain Factors N(n&(M-1)) selected data sample out of the data set representation thereof S(0) . . . S(M-1) noise reduced complex DFT-spectrum values s(n) sample of desired noise free output signal, assigned to index n S(f) according continuous complex DFT-spectrum, assigned to frequency f f natural frequency s(t) continuous and analog noise free output signal The denomination n&(M-1) thereby signifying a selection process, generating data associated to a 'logical and' combination of the discrete time variable as running or counting index n with the M FFT calculated data corresponding to said DFT-spectrum values, observing an 'n modulo M' rule, which guarantees that there is only one non-ambiguous and permitted choice possible and valid. Mathematically is 'n modulo M' defined as the integer remainder, resulting of a divisional operation of integer n by integer M, e.g. n=9 and M=4 leading to a division result=2 with division remainder=1 thus '9 modulo 4'=1.

Looking at FIG. 1B the most significant difference in the operation of the essential processing stages between prior art realizations and an embodiment for the present invention is demonstrated. Within block 10 the Sample-Wise Fast Fourier Transformation (FFT) processing is recursively performed; namely at each sample n all the M spectrum values for an incoming noisy signal x(n) during one sampling period are calculated using the recursion formulas (1.3a&b) given later, producing M FFT values X(n,k), whereby n is a 'discrete time variable' in x(n) and k the 'normalized frequency number or index' in X(n,k). Out of these M results X(n,k) 30 fed together in parallel into the Multiplexer block 30 one value X(n,k) is selected by said multiplexer 30 and put into the Noise Reduction Processing Unit 50 for its further processing to achieve the desired "noise free" resulting signal s(n), whereby the calculations for only one frequency number k has to be done at the same time, which is very time economic and thus leading to real-time results with virtually no significant delay. However it has to be guaranteed, that every frequency number k is selected at least once within a time frame or data set of M incoming samples. Compared to prior art solutions (as already described with the help of FIG. 1A prior art) the recursive FFT calculation algorithms and the selection schemes introduced by the multiplexer are the new key points of this invention.

Figure 2:
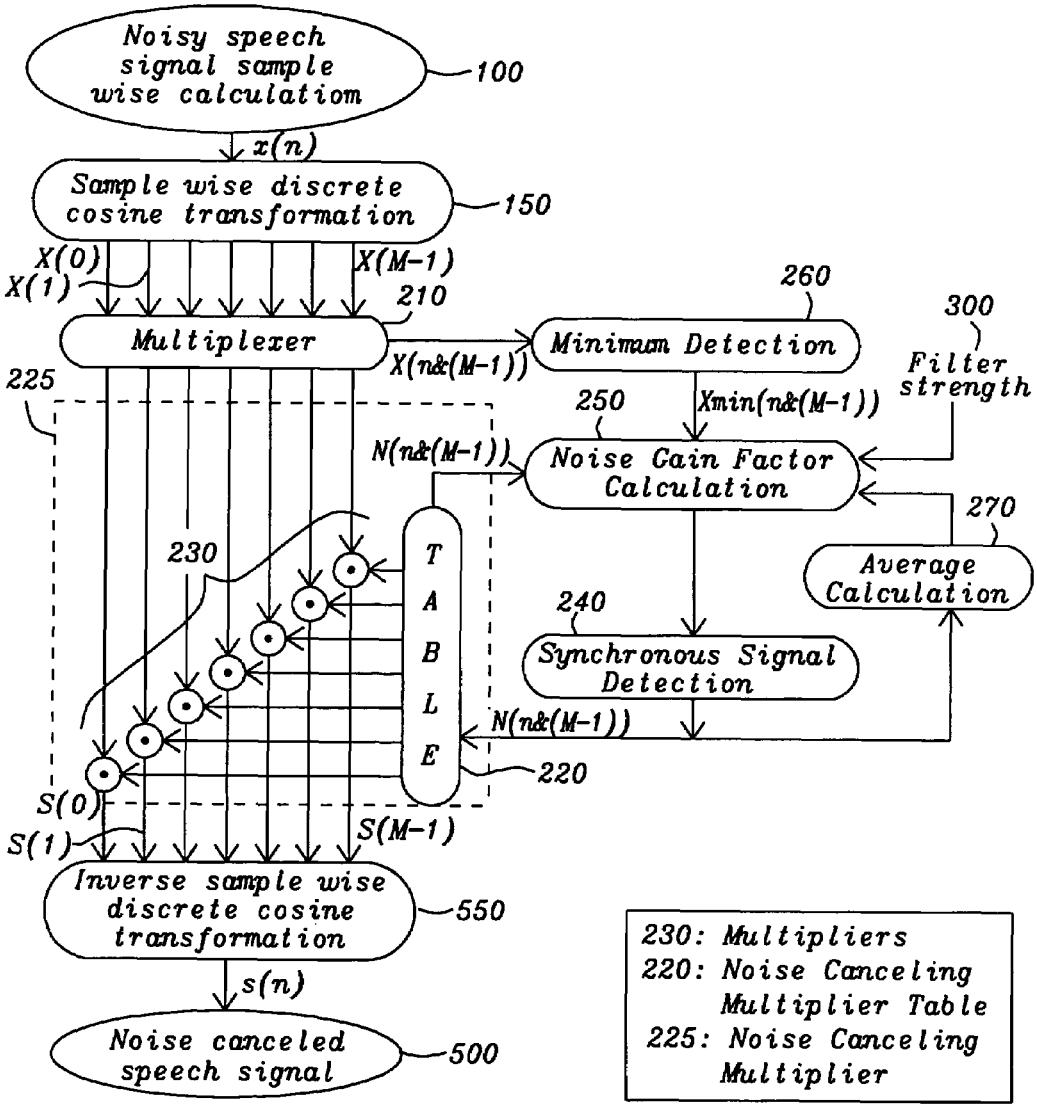
FIG. 2 shows the building blocks for the preferred embodiment of the present invention i.e. the block diagram of the noise suppression system. The block diagram shows the essential circuit blocks realizable with a variety of modern monolithic integrated-circuit technologies.

Referring now to the elements in FIG. 2, the preferred embodiment of the circuit implementing the method of the present invention is illustrated. The essential functional components, so called processing units of the digital circuit together with two symbols, representing the input (item 100) and output (item 500) speech signals, are shown as items 150 to 550, which are explained below in more detail in the section entitled "Description of the Processing Units for the Delay Free Noise Cancelation System". Subsequently explained is the cooperation of these processing units, in order to realize said new method of the invention for the noise suppression or even noise cancelation described in the section "Spectral Minimum Detection (SMD) with Noise Gain Factors (NGF)", see the flow diagrams in FIGS. 5A-5C and FIGS. 6A-6F. Said method is derived from a pertinent theoretical background, the relevant formulas thereof are also given and explained in the following mathematical insertion, explaining the algorithms used, with formulas (1.0), (1.1), (1.2a&b), (1.3a&b), (1.4), (1.5) and (1.6a&b) and all contained in the last section about the underlying theory named "Theory of the Sample-Wise Discrete Cosine Transformation (DCT)".

Reverting now to FIG. 2, in symbol 100 the noisy speech input signal is represented, namely as a series of already digitized words of sound sample data—a so called data stream x(n), ready for being processed according to the method of the invention in the following sample-wise calculation. Unit 150, named "Sample-Wise Discrete Cosine Transformation" receives this data stream of sound samples x(n) for the according sample-wise Discrete Fourier Transformation calculation step, resulting in M data words X(0) to X(M-1), describing the spectrum of that sound sample x(n). As an option here, Hann windowing in the frequency domain can be additionally performed. These M spectrum data words X(0) to X(M-1) are then delivered via a "Multiplexer" 210 in parallel into M multipliers 230, part of the "Noise Canceling Multiplier" unit 225 and serially clocked into a "Minimum Detection" unit 260 selected as per X(n&(M-1)). These serial spectrum data words X(n&(M-1)) are therein processed to evaluate the minimum value $X_{min}$(n&(M-1)) for that signal sample, which is thus fed into the "Noise Gain Factor Calculation" unit 250. This "Noise Gain Factor Calculation" unit 250 possesses a total of four inputs, receiving as input values besides $X_{min}$(n&(M-1)), a Filter Strength value (item 300), which is separately evaluated, an average Noise Gain Factor (NGF) value furnished from an "Average Calculation" unit 270, and a series of previous NGF values selected as per N(n&(M-1)), clocked in from the "Noise Canceling Multiplier Table" unit 220, part of the "Noise Canceling Multiplier" unit 225. Out of these four input signals a new series of NGF values N(n&(M-1)) is then calculated and fed via a "Synchronous Signal Detection" unit 240 into the "Noise Canceling Multiplier Table" unit 220 of the "Noise Canceling Multiplier" unit 225. These new series of NGF values still selected as per N(n&(M-1)) is fed also into the "Average Calculation" unit 270 as input values. The new series of NGF values N(n&(M-1)) is then switched through the "Noise Canceling Multiplier Table" unit 220 as multiplication factors N(0) to N(M-1) into the M "Multipliers" of the "Noise Canceling Multiplier" unit 225, where the recent spectrum data words X(0) to X(M-1)—of the noisy speech input signal—are awaiting processing. The multiplication process of the spectrum data words X(0) to X(M-1) with the NGF values N(0) to N(M-1) then generates new, noise canceled data values S(0) to S(M-1), which are then reversely transformed in the "Inverse Sample-Wise Discrete Cosine Transformation" unit 550, back into the noise canceled speech signal s(n), represented by symbol 500. Summarizing some essentials we find, that the incoming samples of data stream x(n) are counted or enumerated using said discrete time variable n as counting index thus n appearing as a counter, and that all the noise reduction processing happens within a time frame defined by a set of M incoming samples x(n) using M Noise Gain Factors (NGF) determined by the new method of the invention. This method selects one NGF out of said set of M NGFs via said 'n modulo M' rule or if M is a power of 2 (as required by the DFT algorithm) the notion 'n&(M-1)' selecting said respective NGF item, denoted N(n&(M-1)). Within a complete cycle processing all M values X(n) by multiplying them with said NGF values N(n&(M-1)) furnishes said set of M respective results S(n). The main problem solved hereby is to select each frequency number k at least once within said set of M incoming samples x(n) and thus delivering a noise free set of M output signal values s(n) without any significant delay.

Now delving again into FIG. 2, the following section describes the purpose and function of every unit in greater detail:

Description of the Processing Units for the Delay Free Noise Cancelation System.

"Sample-Wise Discrete Cosine Transformation" Unit: Item 150

According to the "Theory of the Sample-Wise Discrete Cosine Transformation (DCT)" the stream of sound samples x(n) is transformed into the Fourier spectrum at every sample. Formulas (1.3a) and (1.3b) are used for the transformation of x(n) into X(0) . . . X(M-1), where the X are split into their real and their imaginary parts $X_{real}$ and $X_{imag}$. The mathematical expressions of equations (1.3a) and (1.3b)—see below—are essentially new as derived later; the variables s & S—generic for signal—solely being replaced by x & X as used here.

"Multiplexer" Unit: Item 210.

The "Multiplexer" unit 210 selects one (or more) of M frequency bands for each incoming sample and sends these selected values X(n&(M-1)) to the "Minimum Detection" unit 260. The succession of these selections is not important, but every frequency has to be selected at least once within each set of M incoming samples. Said M frequency bands are FFT values X(n,k) or simply X(n), whereby n is a 'discrete time variable' in x(n) and k the 'normalized frequency number or index' in X(n,k). Out of these M results X(n) fed together in parallel into the Multiplexer block 210 one value X(n) is selected by said multiplexer 210 according to X(n&(M-1)) and put into the "Minimum Detection" unit 260, whereby (n&(M-1)) describes the above defined 'n modulo M' selection of frequency numbers k and which is why all the following calculations have to be done for only one frequency number k at the same time, therefore being very time economic and thus leading to real-time results with virtually no significant delay. However, as already stated, it has to be guaranteed, that every frequency number k is selected at least once within a time frame or data set of M incoming samples.

"Minimum Detection" Unit: Item 260.

The "Minimum Detection" unit 260 detects the absolute minimum of the amplitude value of X(n) for each frequency band for a period of a few hundred milliseconds in the past. Therefore a history buffer with at least two values for each frequency band has to be used. Each value contains the minimum for a certain section of time and the absolute minimum for the whole period is the absolute minimum of all values for each frequency. The length of the whole period depends on the application, but normally values between 100 (better 300) ms and 1000 (better 800) ms are used. For a better performance the value sets coming from the "Multiplexer" unit 210 are to be averaged for a short time (~80 ms). The absolute minimum $X_{min}$(n) is sent to the "Noise Gain Factor Calculation" unit 250.

"Noise Gain Factor Calculation" Unit: Item 250

The $X_{min}(n)$ value can be defined as the energy of the noise floor and has to be subtracted from the noisy speech signal. For a better quality of the noise reduction it is possible to calculate a Noise Gain factor N(n), which can be multiplied to the Fourier components instead of subtracting $X_{min}(n)$ from X(n). So if S(n) is the desired noise free spectrum $$S(n)=X(n)-X_{min}(n)=N(n)*X(n), \text{ then}$$

$$N(n)=1.0-X_{min}(n)/X(n) \text{ for all } X(n)!=0$$

is the resulting Noise Gain factor. Because $X_{min}$ is only an estimation of the noise floor, it is useful to add a Filter Strength factor with values between 0.0 (no filtering at all) and 1.0 (maximum filter strength) to the formula, so that $$N(n)=1.0-X_{min}(n)/X(n)*\text{Filter Strength for all } X(n) !=0.$$

This Filter Strength value can be chosen as a constant or can be dynamically varied by using a nonlinear function between the filter strength and the averaged Noise Gain Factors N(0) . . . N(M-1) coming from the "Average Calculation" unit 270. At least the Noise Gain Factor N(n) should be averaged for a better performance and is sent to the "Synchronous Signal Detection" unit 240.

"Synchronous Signal Detection" Unit: Item 240

The "Noise Gain Factor" method has the property, that if the neighbor frequencies reduce the speech signal, it is impossible that the actual observed and treated frequency is not reduced by the noisy speech signal. The multiplication factors of the Noise Canceling Multipliers are 1 if the signal is mainly speech in the corresponding frequency band, smaller than 1 if there is speech and noise in the corresponding frequency band and 0 if there is only noise in the corresponding frequency band.

Figure 3A:
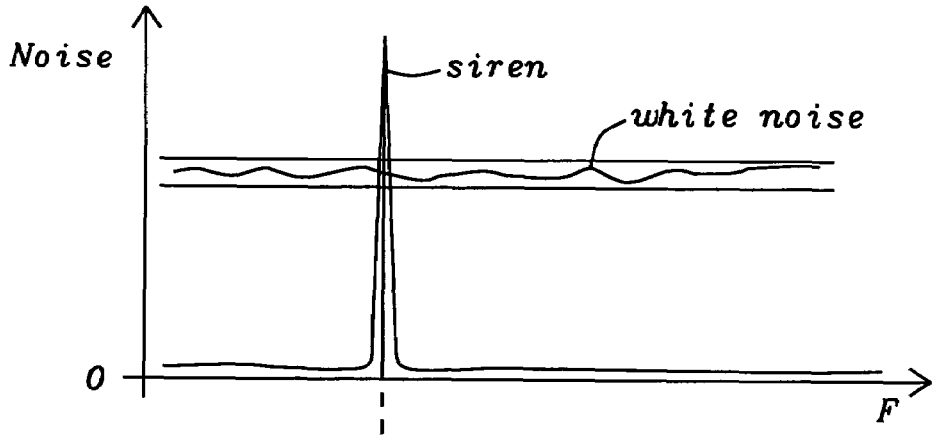
FIGS. 3A and 3B depicts in form of a frequency diagram the influence of a suddenly appearing noisy disturbance, called a siren, on the values of the Noise Gain Factor (NGF) compared to the normal white noise behavior.
Figure 3B:
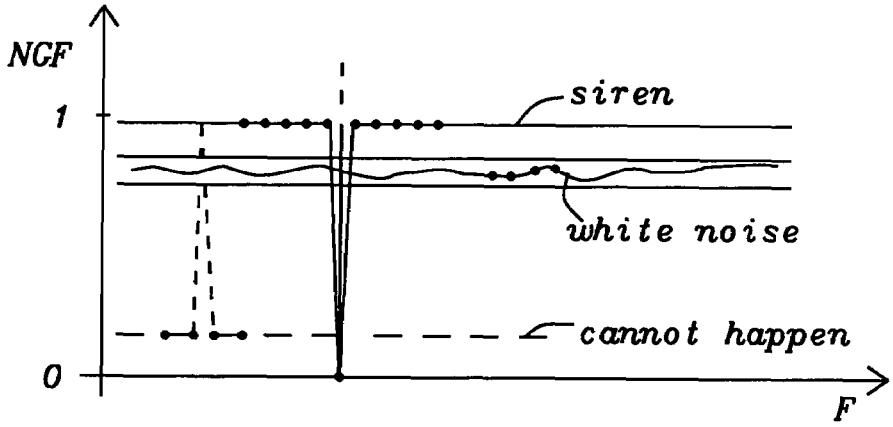

With the help of FIGS. 3A and 3B an important phenomenon with regard to noise reduction will now be described in greater detail. There are two different classes of noise: white noise and sirens. Most background noises behave like noise out of one of these classes. "White noise": all frequency bands have similar signal to noise ratio and therefore the multiplication factors of the Noise Canceling Multipliers in the neighborhood are very similar (and lower than 1). "Siren signals": One frequency band has the whole noise energy; the neighbor frequencies have much smaller energy. The multiplication factor of the Noise Canceling Multiplier of this frequency band is much lower than the multiplication factors at the neighbor frequencies. FIG. 3A and FIG. 3B illustrate the results achieved with an apparatus, which puts the noise suppression method of the invention into practice with an exemplary realization. The significance of the Noise Gain Factor (NGF) can be clearly observed. What never happens in the real world is that the multiplication factor of the Noise Canceling Multiplier of one frequency band is much higher than the neighbor multiplication factor, because that would signify, that there is a noise floor everywhere else, except in one frequency band. But this effect happens if the algorithm detects in a noise floor (unwanted) modulation frequencies of speech, which leads to so-called "musical tones".

The "Synchronous Signal Detection" unit 240 takes care of it and reduces the multiplication factor of the Noise Canceling Multiplier to make sure, that no musical tones appear. In the case of an estimation failure it is possible, that this situation may occur and these so-called "musical tones" can be heard, which are fundamentally unwanted artifacts. The "Synchronous Signal Detection" unit 240 detects such situations by comparing the neighbor frequencies and reduces this effect, as described above. The newly calculated Noise Gain Factor replaces the old value in the buffer of the "Noise Canceling Multiplier" unit 225 and the value is sent additionally to the "Average Calculation" unit 270.

"Average Calculation" Unit: Item 270.

The "Average Calculation" unit 270 calculates the average about all Noise Gain Factors N(0) . . . N(M-1). This value can then be used for a dynamic adjustment of the Filter Strength value.

"Noise Canceling Multiplier" Unit: Item 225.

The "Noise Canceling Multiplier" unit 225 contains a buffer for all Noise Gain Factors additionally to its internal serial/parallel converter, thus forming a "Noise Canceling Multiplier Table" unit (item 220). The "Noise Canceling Multiplier" unit 225 is responsible for the subtraction of the noise by multiplying each Noise Gain Factor N(n) with the corresponding X(n), using e.g. M multipliers (items 230). The result is the wanted noise reduced speech signal S(n). It is further possible to integrate an amplification of the speech signal to compensate for the energy loss resulting from the subtraction of the noise energy. Such a virtually noise canceled speech signal output can be reached.

"Noise Canceling Multiplier Table" Unit: Item 220.

The "Noise Canceling Multiplier Table" unit 220 contains some sort of registers or memory cells organized in form of a table for all processed Noise Gain Factors delivered from the "Synchronous Signal Detection" unit 240 as an intermediate storage area for the "Noise Gain Factor Calculation" unit 250 and the serial/parallel converter handles the allocation of the sequentially provided Noise Gain Factors to the appropriate multipliers 230 of the "Noise Canceling Multiplier" unit 225. At each incoming sample one (or more) Noise Gain Factors are recalculated and stored back into the table.

"Inverse Sample-Wise Discrete Cosine Transformation" Unit: Item 550.

The last step in the calculation is the inverse Fourier transformation that is done in the "Inverse Sample-Wise Discrete Cosine Transformation" unit 550. According to the "Theory of the Sample-Wise Discrete Cosine Transformation" the noise reduced spectrum S(0) . . . S(M-1) coming from the "Noise Canceling Multiplier" unit 225 will be transformed into the next sample s(n) of the output signal. The new and important equation (1.6a)—see below—is used for this calculation. It is further possible to integrate a definable delay into the output by changing the phases of each frequency value. Therefore it is possible to get the same processing delay for every sampling rate.

Figure 4:
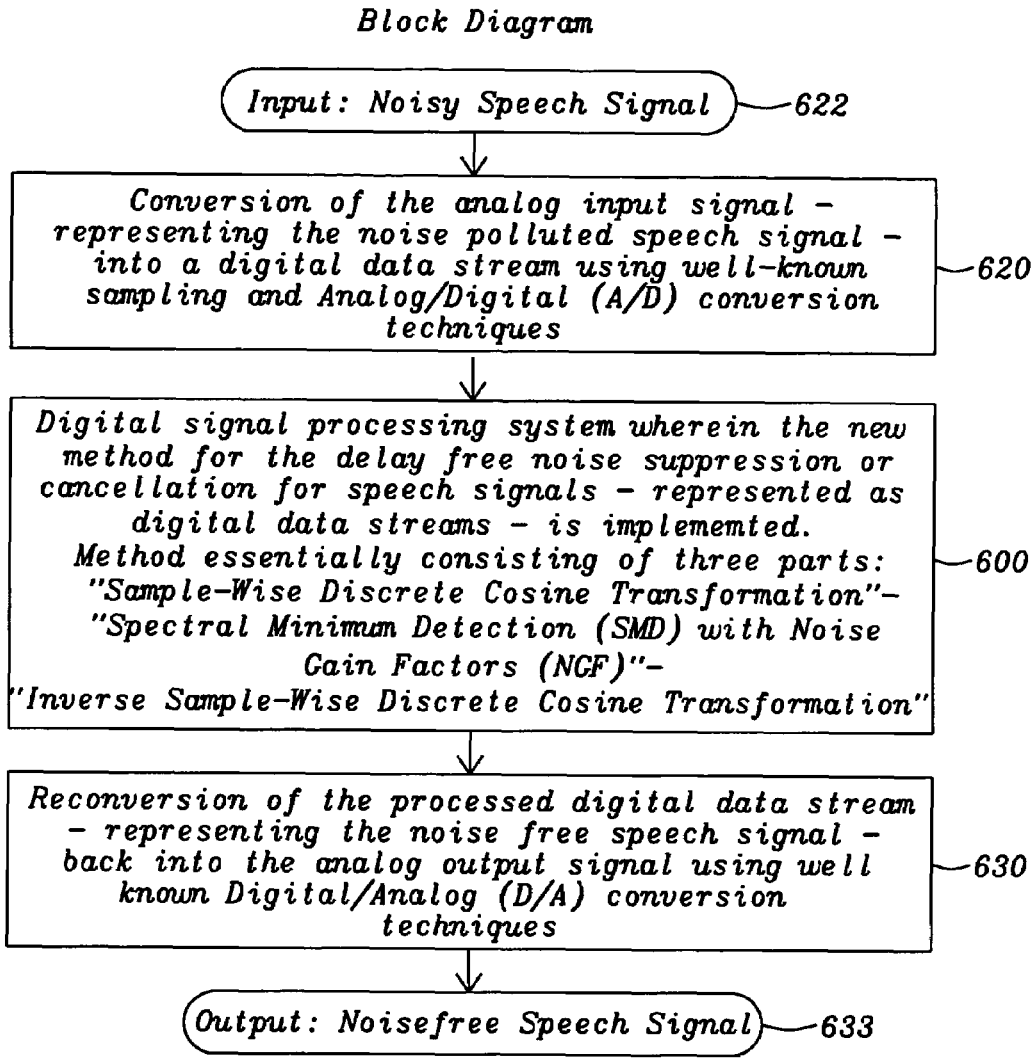
FIG. 4 and FIGS. 5A-5C show in form of a block diagram and a flow diagram an apparatus for the implementation of the invention.
Figure 5A:
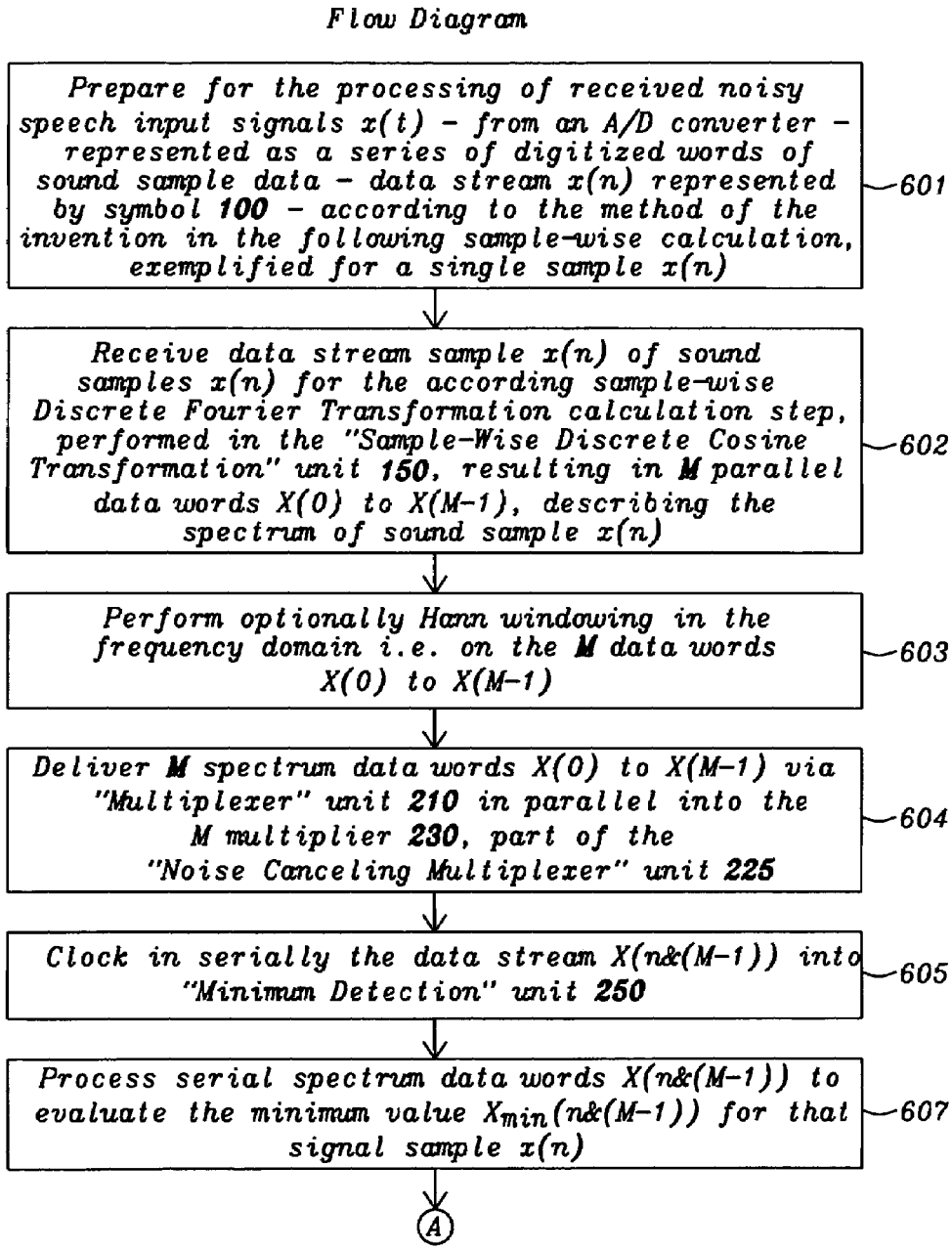
Figure 5B:
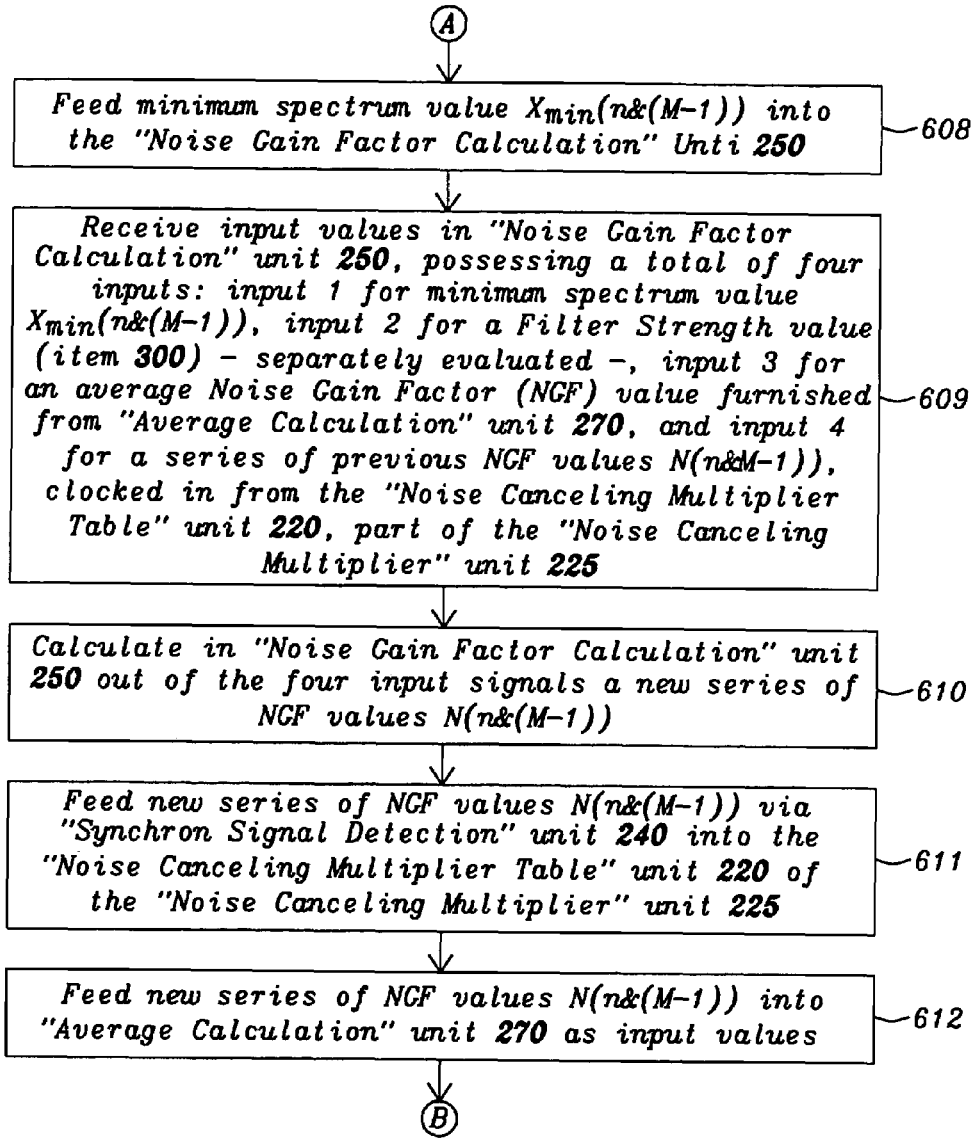
Figure 5C:
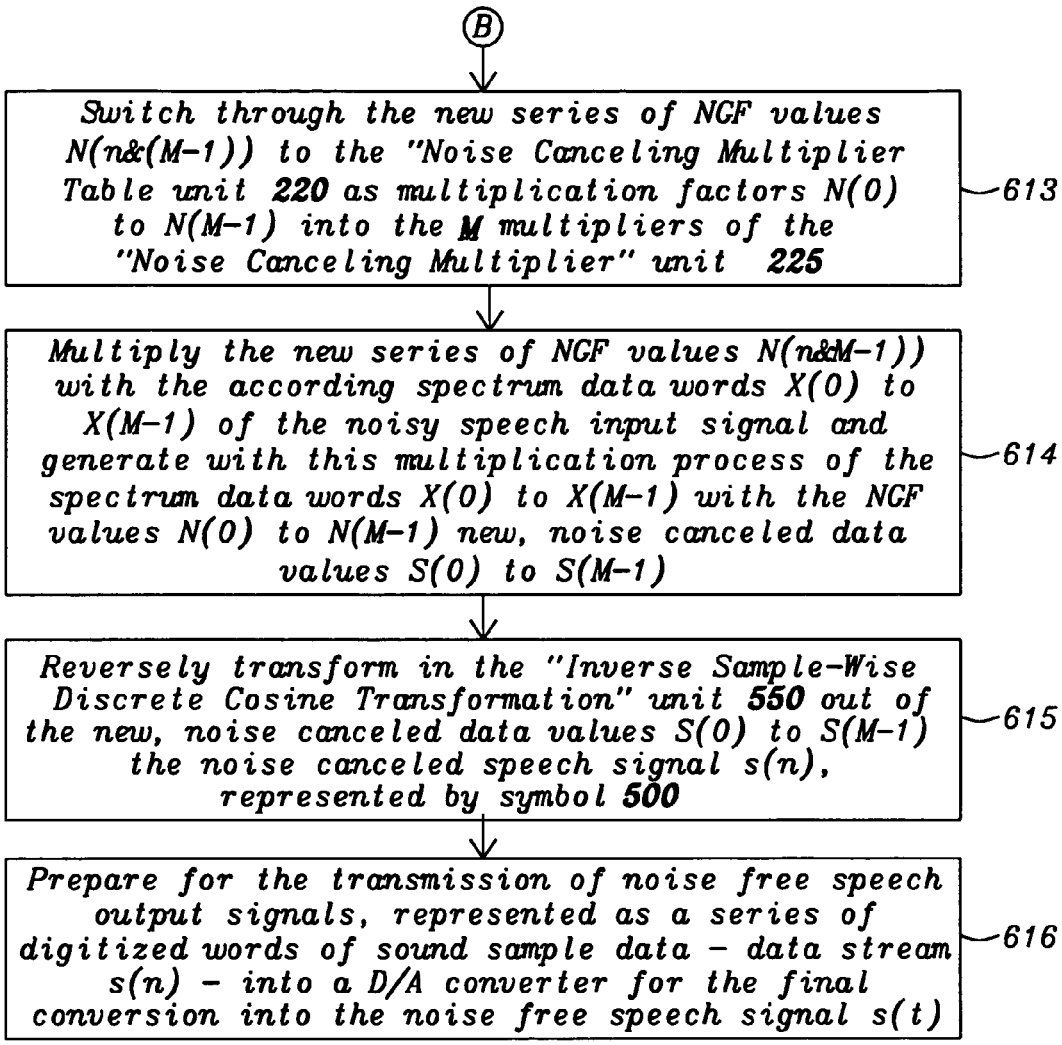
Figure 6B:
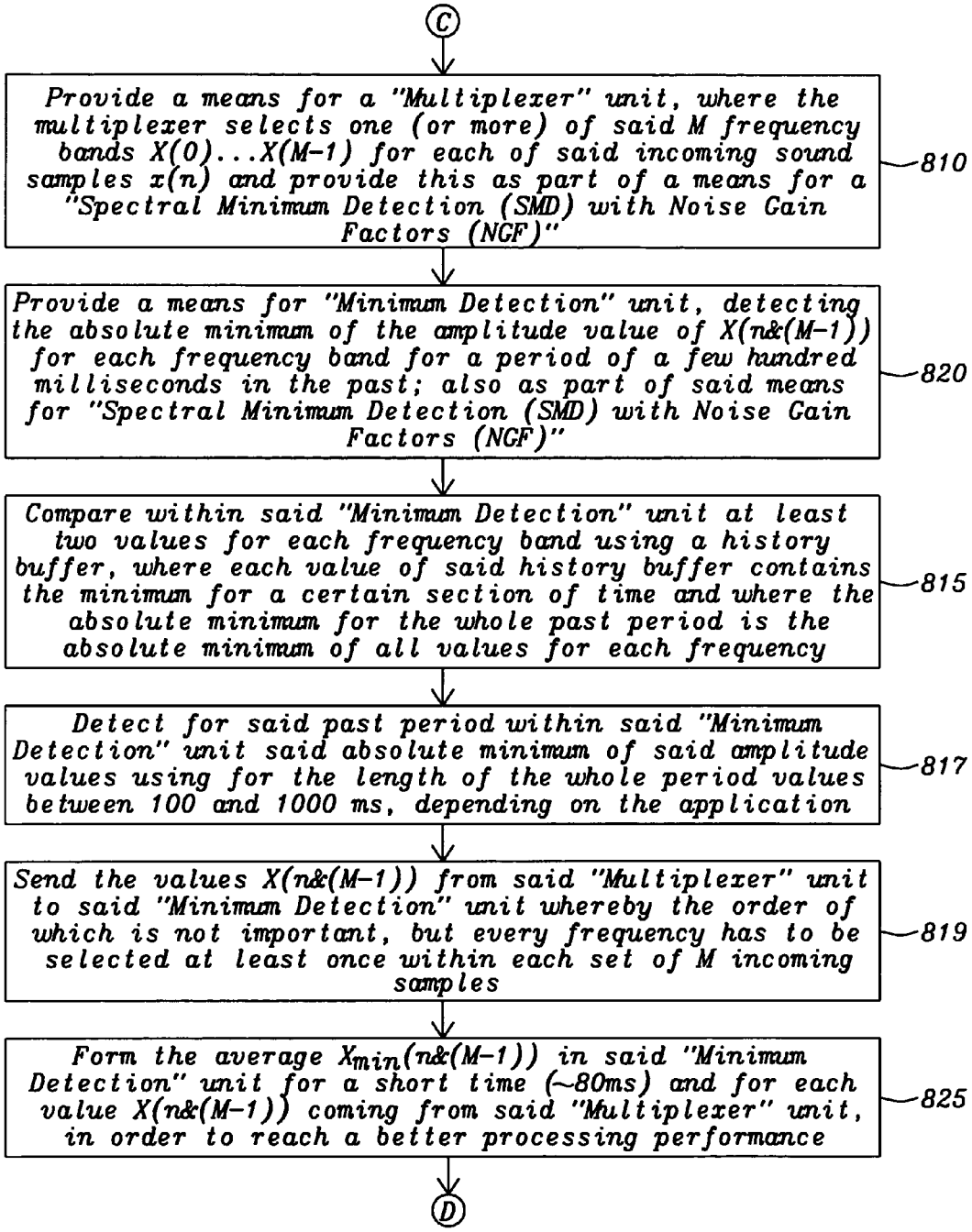
Figure 6C:
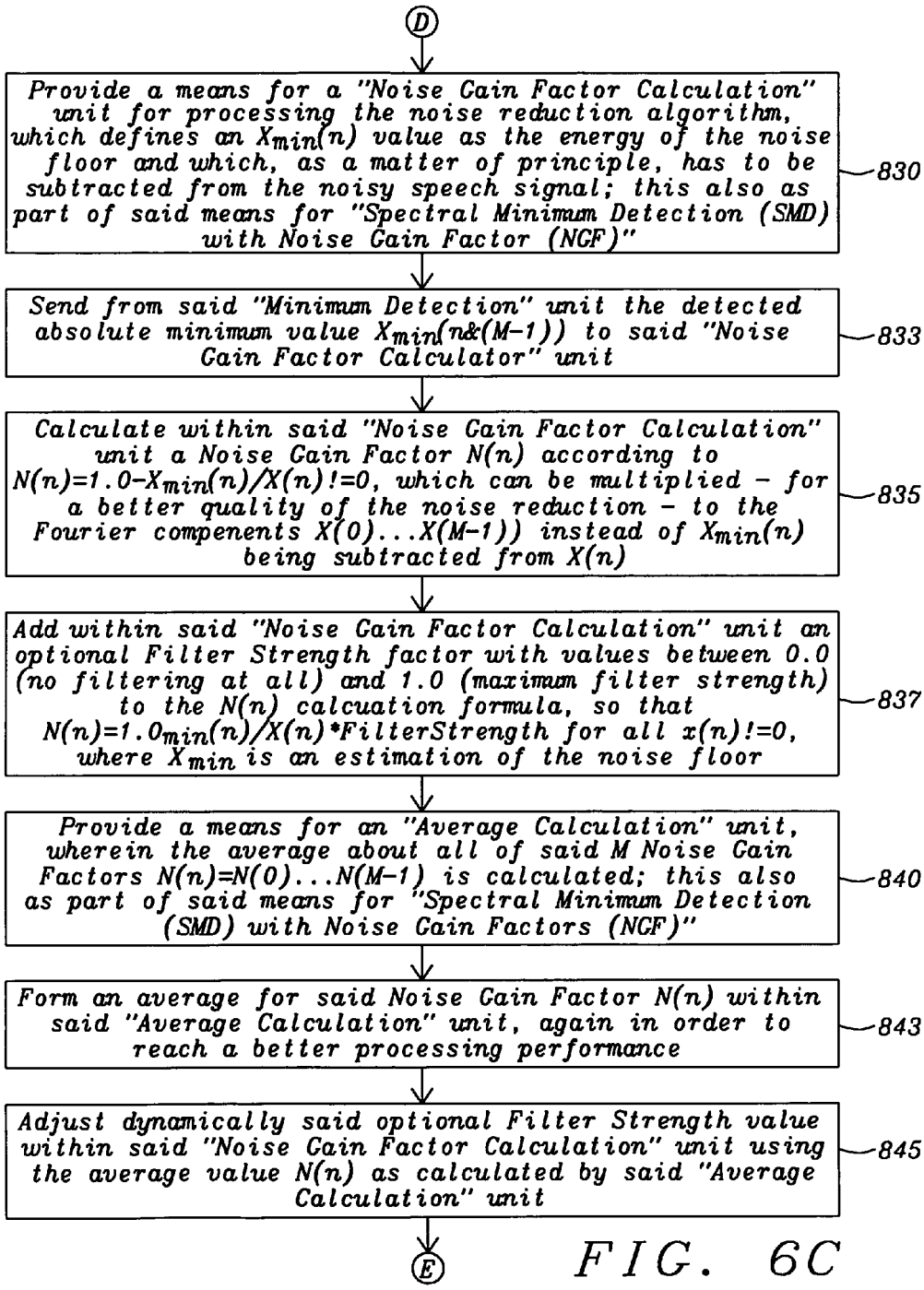
Figure 6D:
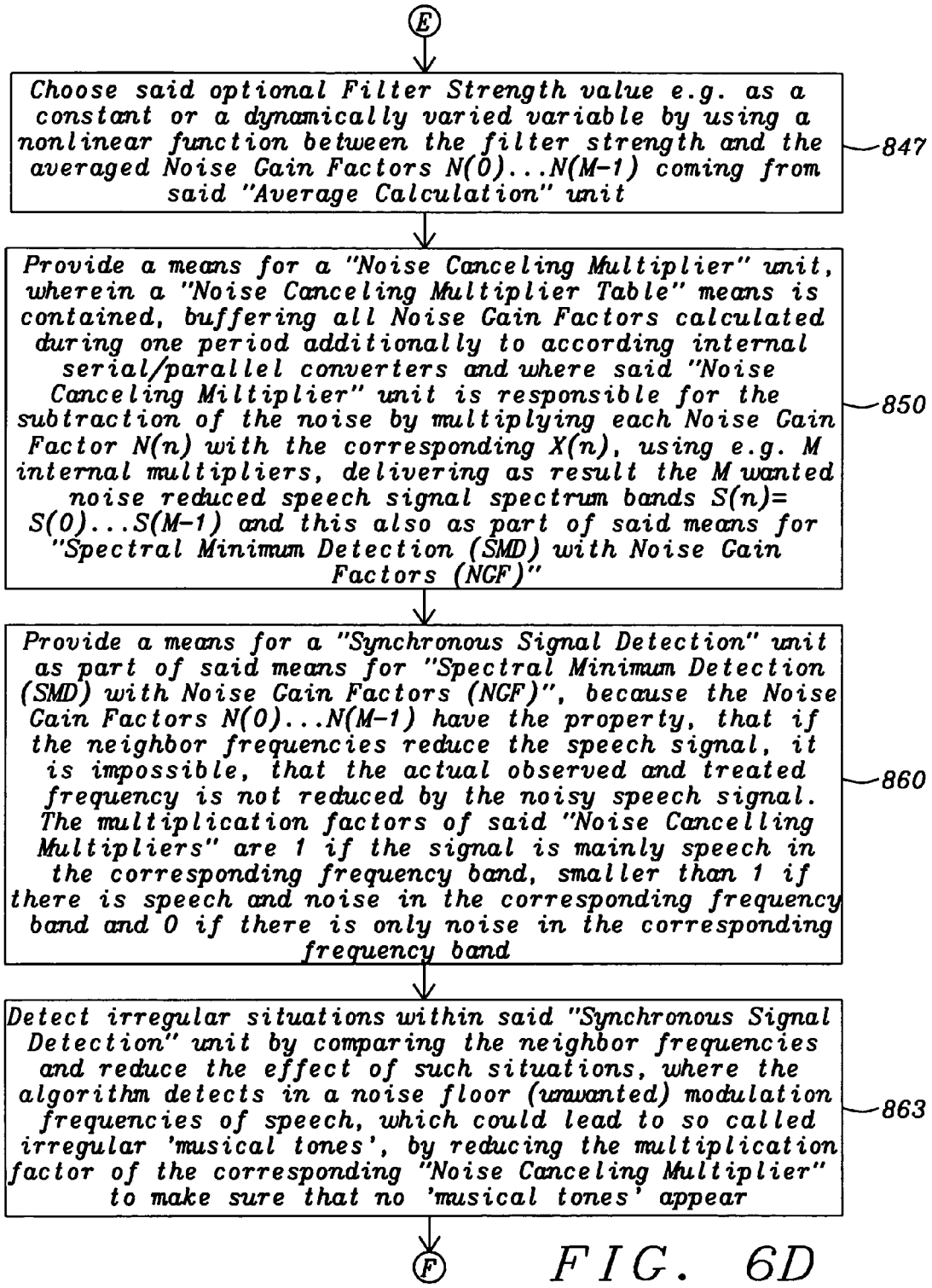
Figure 6E:
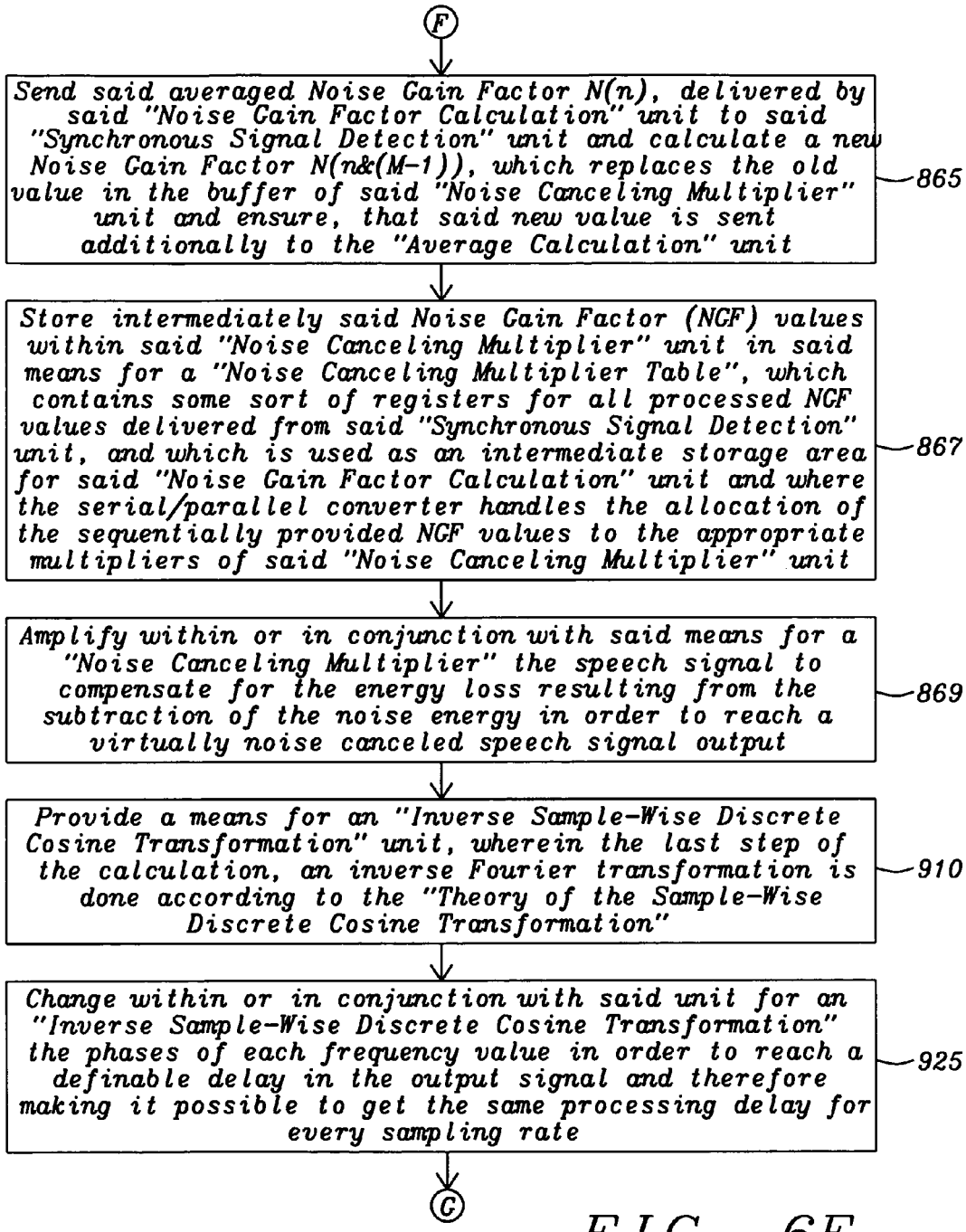
Figure 6F:
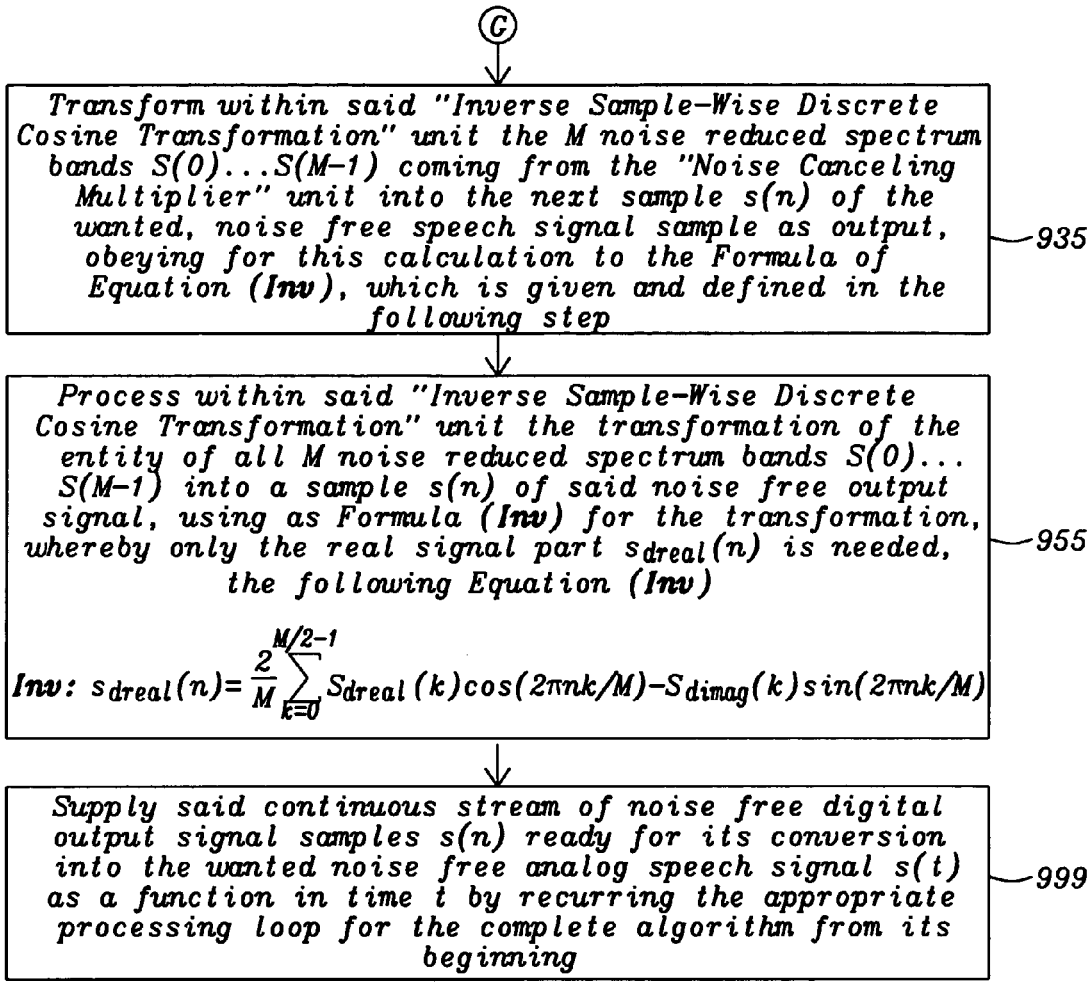

Regarding the two diagrams in FIG. 4 and in FIGS. 5A-5C and in order to clarify the function and the cooperation of the above described units the following section describes the new and governing method of the invention in more detail: first a block diagram for a standard implementation is given in FIG. 4 and second a flow diagram for the essential methodic steps of the noise suppression algorithm implemented therein is presented with FIGS. 5A-5C.

Referring now to the overall block diagram of FIG. 4 the general principle for an apparatus realizing a modern digital system operating on analog input signals and delivering analog output signals is shown. Hereby digitally processing sound signals or even more specific speech signals and using a means specialized to realize the delay free noise suppression method of the invention.

It is understood and common knowledge to any skilled artisan in this field, thus only inserted here for clarity and definition of terms, that each electronical communication system dealing with sound transmission such as phones, sound transceivers or recorders has to make use of a physical sound transformation into analog electric signals by the help of microphones or acoustical oscillation receivers summarized as sound sensors and used as physical input device, whereas on the output side of that electronical communication system it is retransforming its analog electric output signals again into physical sound by general sound actors such as loudspeakers or acoustical earpieces used as physical output device.

In the starting block 620 the analog input signal 622—representing the noise polluted speech signal—is converted to a digital data stream using well-known sampling and Analog/Digital (A/D) conversion techniques. Block 600 contains as a whole the digital signal processing system wherein the new method for the delay free noise suppression or cancelation for speech signals—represented as digital data streams—is implemented. This new method essentially consists of three parts: first a "Sample-Wise Discrete Cosine Transformation" part and second the "Spectral Minimum Detection (SMD) with Noise Gain Factors (NGF)" part and third an "Inverse Sample-Wise Discrete Cosine Transformation" part. The final block 630 then reconverts the processed digital data stream—representing the noise free speech signal—back into the analog output signal 633, which is the desired noise free speech signal, using well-known Digital/Analog (D/A) conversion techniques.

Referring now to FIGS. 5A-5C, the contents from within block 600 is described with the help of a flow diagram, detailing said noise suppression method and their implementation units. Said method implemented in the apparatus of the invention is explained in single steps, referring to the units shown in and explained with the help of FIG. 2 and in the explanations given above. These method steps are dealing with signals, both time signals x(t) and sampled signals x(n), their corresponding spectrum data X(0) to X(M-1), and essentially the Noise Gain Factor (NGF) values N(n&(M-1)), key values for the whole algorithm of said method; where the symbolic argument n&(M-1) signifies the particular value, associated to a 'logical and' combination of said running or counting index n of said input signal stream and the respective spectrum data of said M spectral data words, as provided by the already introduced multiplexer.

A first step 601 in said method prepares for the processing of received noisy speech input signals x(t)—from an A/D converter—represented as a series of digitized words of sound sample data—data stream x(n) represented by symbol 100—according to the method of the invention in the following sample-wise calculation, exemplified for a single sample x(n), the second step 602 then receives data stream sample x(n) of sound samples x(n) for the according sample-wise Discrete Fourier Transformation calculation step, performed in the "Sample-Wise Discrete Cosine Transformation" unit 150, resulting in M parallel data words X(0) to X(M-1), describing the spectrum of sound sample x(n). The next operational steps (603-607) of said method optionally perform a Hann windowing in the frequency domain i.e. on the M data words X(0) to X(M-1), deliver said M spectrum data words X(0) to X(M-1) via "Multiplexer" unit 210 in parallel into the M multipliers 230, part of the "Noise Canceling Multiplier" unit 225, are serially clocking in the data stream of selected values X(n&(M-1)) into said "Minimum Detection" unit 260 and process said M serial spectrum data words X(n&(M-1)) to evaluate the minimum value $X_{min}$(n&(M-1)) for that signal sample x(n). The following step of method 608 feeds said minimum spectrum value $X_{min}$(n&(M-1)) into the "Noise Gain Factor Calculation" unit 250. Another following step of method 609 then receives the input values in the "Noise Gain Factor Calculation" unit 250, possessing a total of four inputs: input 1 for minimum spectrum value $X_{min}$(n&(M-1)), input 2 for a Filter Strength value (item 300)—separately evaluated—, input 3 for an average Noise Gain Factor (NGF) value furnished from "Average Calculation" unit 270, and input 4 for a series of previous NGF values N(n&(M-1)), clocked in from the "Noise Canceling Multiplier Table" unit 220, part of the "Noise Canceling Multiplier" unit 225. Calculating in said "Noise Gain Factor Calculation" unit 250 out of the four input signals a new series of NGF values N(n&(M-1)) is accomplished in this step 610. The now two following steps (611 & 612) feed the new series of NGF values N(n&(M-1)) via "Synchronous Signal Detection" unit 240 into the "Noise Canceling Multiplier Table" unit 220 of the "Noise Canceling Multiplier" unit 225 and feed this new series of NGF values N(n&(M-1)) also into "Average Calculation" unit 270 as input values. The next two steps of the method (613 & 614) are switching through the new series of NGF values N(n&(M-1)) to the "Noise Canceling Multiplier Table" unit 220 as multiplication factors N(0) to N(M-1) into the M multipliers of the "Noise Canceling Multiplier" unit 225, and multiply the new series of NGF values N(n&(M-1)) with the according spectrum data words X(0) to X(M-1) of the noisy speech input signal and generate with this multiplication process of the spectrum data words X(0) to X(M-1) with the NGF values N(0) to N(M-1) the new, noise canceled data values S(0) to S(M-1). A separate step 615 reversely transforms in the "Inverse Sample-Wise Discrete Cosine Transformation" unit 550 out of the new, noise canceled data values S(0) to S(M-1) the noise canceled speech signal s(n), represented by symbol 500. Preparing for the transmission of noise free speech output signals, represented as a series of digitized words of sound sample data—data stream s(n)—into a D/A converter for the final conversion into the noise free speech signal s(t) is the final step 616 of the method, as implemented by said apparatus of the invention.

Delving deeper now into the FIGS. 6A-6F, an exceedingly detailed description of said method for noise suppression is presented somewhat more generally, however following the above introduced division into three parts: A "Sample-Wise Discrete Cosine Transformation" part (items 710 . . . 717), a "Spectral Minimum Detection (SMD) with Noise Gain Factors (NGF)" part (items 810 . . . 869), and an "Inverse Sample-Wise Discrete Cosine Transformation" part (items 910 . . . 999).

Said new method is starting off for part one with the first three steps 710, 715 & 717, which provide in step 710 a means for a "Sample-Wise Discrete Cosine Transformation", wherein according to the "Theory of the Sample-Wise Discrete Cosine Transformation (DCT)" a continuous stream of sound samples x(n) is transformed all along into its Fourier spectrum X, represented by M frequency bands X(0) . . . X(M-1), and evaluated for every sample and wherein the Formulas (Re) and (Im)—as given and defined in the following two steps for the real and imaginary parts correspondingly—are used for the transformation of x(n) into X(0) . . . X(M-1); the X thereby split into their real and their imaginary parts, $X_{real}$ and $X_{imag}$; n thereby being the running counter index of said continuous input stream of sound samples and M the number of frequency bands observed in said time frame, and which transform (step 715) within said means for a "Sample-Wise Discrete Cosine Transformation" sound sample x(n) into the real parts of the Fourier spectra X(0) . . .

X(M-1) using as Formula (Re) for the transformation the following recursive Equation (1.3a)—as derived and explained later—

$$Re: S_{dreal,n}(k)=S_{dreal,n-1}(k)+(s_{dreal}(n)-s_{dreal}(n-M))\cos(2\pi nk/M) \quad (1.3a)$$

where, in the mathematical expression—the variables s & S—generic for signal—have to be replaced by x & X as used here and already defined above, whereby d denotes the application of a discrete Fourier transform algorithm with k as its frequency number or index representing the discrete resulting frequency lines for the frequency band observed and also transform (step 717) within said means for a "Sample-Wise Discrete Cosine Transformation" sound sample x(n) into the imaginary parts of the Fourier spectra X(0) . . . X(M-1) using as Formula (Im) for the transformation the following recursive Equation (1.3b)—as derived and explained later—

$$Re: S_{dreal,n}(k)=S_{dreal,n-1}(k)+(s_{dreal}(n-M)-s_{dreal}(n))\sin(2\pi nk/M) \quad (1.3b)$$

where, in the mathematical expression—the variables s & S—generic for signal—have to be replaced by x & X as used here and already defined above, whereby d denotes the application of a discrete Fourier transform algorithm with k as its frequency number or index representing the discrete resulting frequency lines for the frequency band observed.

The now following twenty steps (items 810 . . . 869) for part two of said method are itemized as follows: step 810 provides a means for a "Multiplexer" unit, where the multiplexer selects one (or more) of said M frequency bands X(0) . . . X(M-1) for each of said incoming sound samples x(n) and provide this as part of a means for a "Spectral Minimum Detection (SMD) with Noise Gain Factors (NGF)"; step 820 provides a means for a "Minimum Detection" unit, detecting the absolute minimum of the amplitude value of X(n&(M-1)) for each frequency band for a period of a few hundred milliseconds in the past; also as part of said means for "Spectral Minimum Detection (SMD) with Noise Gain Factors (NGF)"; step 815 compares within said "Minimum Detection" unit at least two values for each frequency band using a history buffer, where each value of said history buffer contains the minimum for a certain section of time and where the absolute minimum for the whole past period is the absolute minimum of all values for each frequency; step 817 detects for said past period within said "Minimum Detection" unit said absolute minimum of said amplitude values using for the length of the whole period values between 100 and 1000 ms, depending on the application; step 819 sends the values X(n&(M-1)) from said "Multiplexer" unit to said "Minimum Detection" unit, whereby the order of which is not important, but every frequency has to be selected at least once within each set of M incoming samples; step 825 forms the average $X_{min}$(n&(M-1)) in said "Minimum Detection" unit for a short time (~80 ms) and for each value X(n&(M-1)) coming from said "Multiplexer" unit, in order to reach a better processing performance; step 830 provides a means for a "Noise Gain Factor Calculation" unit for processing the noise reduction algorithm, which defines an $X_{min}$(n) value as the energy of the noise floor and which, as a matter of principle, has to be subtracted from the noisy speech signal; this also as part of said means for "Spectral Minimum Detection (SMD) with Noise Gain Factors (NGF)"; step 833 sends from said "Minimum Detection" unit the detected absolute minimum value $X_{min}$(n&(M-1)) to said "Noise Gain Factor Calculation" unit; step 835 calculates within said "Noise Gain Factor Calculation" unit a Noise Gain factor N(n) according to N(n)=10-$X_{min}$(n)/X(n) for all X(n)!=0, which can be multiplied—for a better quality of the noise reduction—to the Fourier components X(0) . . . X(M-1) instead of $X_{min}$(n) being subtracted from X(n); step 837 adds within said "Noise Gain Factor Calculation" unit an optional Filter Strength factor with values between 0.0 (no filtering at all) and 1.0 (maximum filter strength) to the N(n) calculation formula, so that N(n)=1.0-$X_{min}$(n)/X(n)*Filter Strength for all X(n)!=0, where Xmin is an estimation of the noise floor; step 840 provides a means for an "Average Calculation" unit, wherein the average about all of said M Noise Gain Factors N(n)=N(0) . . . N(M-1) is calculated; this also as part of said means for "Spectral Minimum Detection (SMD) with Noise Gain Factors (NGF)"; step 843 forms an average for said Noise Gain Factor N(n) within said "Average Calculation" unit, again in order to reach a better processing performance; step 845 adjusts dynamically said optional Filter Strength value within said "Noise Gain Factor Calculation" unit using the average value N(n) as calculated by said "Average Calculation" unit; step 847 chooses said optional Filter Strength value e.g. as a constant or a dynamically varied variable by using a nonlinear function between the filter strength and the averaged Noise Gain Factors N(0) . . . N(M-1) coming from said "Average Calculation" unit; step 850 provides a means for a "Noise Canceling Multiplier" unit, wherein a "Noise Canceling Multiplier Table" means is contained, buffering all Noise Gain Factors calculated during one period additionally to according internal serial/parallel converters and where said "Noise Canceling Multiplier" unit is responsible for the subtraction of the noise by multiplying each Noise Gain Factor N(n) with the corresponding X(n), using e.g. M internal multipliers, delivering as result the M wanted noise reduced speech signal spectrum bands S(n)=S(0) . . . S(M-1) and this also as part of said means for "Spectral Minimum Detection (SMD) with Noise Gain Factors (NGF)"; step 860 provides a means for a "Synchronous Signal Detection" unit as part of said means for "Spectral Minimum Detection (SMD) with Noise Gain Factors (NGF)", because the Noise Gain Factors N(0) . . . N(M-1) have the property, that if the neighbor frequencies reduce the speech signal, it is impossible, that the actual observed and treated frequency is not reduced by the noisy speech signal. The multiplication factors of said "Noise Canceling Multipliers" are 1 if the signal is mainly speech in the corresponding frequency band, smaller than 1 if there is speech and noise in the corresponding frequency band and 0 if there is only noise in the corresponding frequency band; step 863 detects irregular situations within said "Synchronous Signal Detection" unit by comparing the neighbor frequencies and reduce the effect of such situations, where the algorithm detects in a noise floor (unwanted) modulation frequencies of speech, which could lead to so called irregular 'musical tones', by reducing the multiplication factor of the corresponding 'noise canceling' multiplier to make sure that no 'musical tones' appear; step 865 sends said averaged Noise Gain Factor N(n), delivered by said "Noise Gain Factor Calculation" unit to said "Synchronous Signal Detection" unit and calculate a new Noise Gain Factor N(n&(M-1)), which replaces the old value in the buffer of said "Noise Canceling Multiplier" unit and ensure, that said new value is sent additionally to the "Average Calculation" unit; step 867 stores intermediately said Noise Gain Factor (NGF) values within said "Noise Canceling Multiplier" unit in said means for a "Noise Canceling Multiplier Table", which contains some sort of registers for all processed NGF values delivered from said "Synchronous Signal Detection" unit, and which is used as an intermediate storage area for said "Noise Gain Factor Calculation" unit and where the serial/parallel converter handles the allocation of the sequentially provided NGF values to the appropriate multipliers of said "Noise Canceling Multiplier" unit; and step 869 amplifies within or in conjunction with said means for a "Noise Canceling Multiplier" the speech signal to compensate for the energy loss resulting from the subtraction of the noise energy in order to reach a virtually noise canceled speech signal output.

Within the last five steps (910 . . . 999) for part three of said method, step 910 provides a means for an "Inverse Sample-Wise Discrete Cosine Transformation" unit, wherein the last step of the calculation, an inverse Fourier transformation is done according to the "Theory of the Sample-Wise Discrete Cosine Transformation". Step 925 changes within or in conjunction with said unit for an "Inverse Sample-Wise Discrete Cosine Transformation" the phases of each frequency value in order to reach a definable delay in the output signal and therefore making it possible to get the same processing delay for every sampling rate and step 935 transforms within said "Inverse Sample-Wise Discrete Cosine Transformation" unit the M noise reduced spectrum bands S(0) . . . S(M-1) coming from the "Noise Canceling Multiplier" unit into the next sample s(n) of the wanted, noise free speech signal sample as output, obeying for this calculation to the Formula of Equation (Inv), which is given and defined in the following step 955, which processes within said "Inverse Sample-Wise Discrete Cosine Transformation" unit the transformation of the entity of all M noise reduced spectrum bands S(0) . . . S(M-1) into a sample s(n) of said noise free output signal, using as Formula (Inv) for the transformation, whereby only the real signal part $s_{dreal}(n)$ is needed, the following Equation (1.6b)—as derived and explained later—

Inv: (1.6b)

$$s_{dreal}(n) = \frac{2}{M}\sum_{k=0}^{M/2-1} S_{dreal}(k)\cos(2\pi nk/M) - S_{dimag}(k)\sin(2\pi nk/M)$$

thus summing up all the spectral frequency lines designated by k running from 0 to (M/2)−1, considering said discretely calculated real and imaginary components $S_{dreal}$ and $S_{dimag}$ of the complex spectrum bands S. Step 999 finally supplies said continous stream of noise free digital output signal samples s(n) ready for its conversion into the desired noise free analog speech signal s(t) as a function in time t by recurring the appropriate processing loop for the complete algorithm from its beginning.

For a better understanding of the invention the underlying theory is now summarized and briefly explained in the following section:

Theory of the Sample-Wise Discrete Cosine Transformation (DCT)

A short introduction for the mathematical background of the DFT method of the invention is given here, emphasizing on the newly derived equations (1.3a) and (1.3b), for the evaluation of the signal spectrum out of the noisy speech signal input, in the form of a sample-wise DCT. And further emphasizing on the new equation (1.6a) for the iDCT, as used for the retransformation of the noise canceled signal spectrum back into the clean speech signal output.

Based on the fact, that for continuous and analog signals s(t), i.e. functions of time t, like sound or especially speech signals the associated continuous spectrum S(f) over the frequency f can be calculated using the well known Fourier transformation, the application of modern digital integrated circuits and digital processing techniques leads to the use of sampled digital signals $s_d(n)$, where n is the index of the sample in a period of time. Calculating the according frequency spectrum $S_d(n)$ with the hereby applicable Discrete Fourier Transformation (DFT) gives discrete resulting frequency lines, which are defined through their index k. The number M defines the number of samples necessary for the DFT calculation and chosen corresponding to the observed signal's sample rate under consideration of Shannon's sampling theorem for signal fidelity, thus defines a resultant frequency range or frequency band for every signal sample.

Fourier Transformation for continuous analog signals:

$$S(f) = \int_{-\infty}^{+\infty} s(t)e^{-i2\pi ft}dt \tag{1.0}$$

The DFT form for sampled digital signals:

$$S_d(k) = \sum_{n=0}^{M-1} s_d(n)e^{-i2\pi nk/M} \tag{1.1}$$

The DFT form in Euler's representation:

$$S_d(k) = \sum_{n=0}^{M-1} s_d(n)(\cos(2\pi nk/M) - i\sin(2\pi nk/M)) \quad 0 \le k < M/2$$

or split into real and imaginary parts of the Discrete Cosine Transformation (DCT):

$$S_{dreal}(k) = \sum_{n=0}^{M-1} s_{dreal}(n)\cos(2\pi nk/M) + \underbrace{s_{dimag}(n)\sin(2\pi nk/M)}_{=0} \tag{1.2a}$$

$$S_{dimag}(k) = \sum_{n=0}^{M-1} \underbrace{s_{dimag}(n)\cos(2\pi nk/M)}_{=0} - s_{dreal}(n)\sin(2\pi nk/M) \tag{1.2b}$$

where $S_{dimag}(n)$ is 0 for all n. The Fourier transform, as used here, is only applied to one dimensional signals in the time domain s(t), which have no imaginary part, in other words: also the imaginary parts of all sampled $s_d$ are zero. As however the Fourier transform is defined for imaginary values too and the formulas show the complete version, this is notedly mentioned here. (In the frequency domain, $S_d$ has a real and an imaginary part, $S_{dreal}$ and $S_{dimag}$ as shown in equations 1.2a and 1.2b.)

Is $S_{dreal}(k)$ and $S_{dimag}(k)$ available for n-1 to n-M, the DFT can be calculated with the next sample s(n) for the range n to n-(M-1) as follows:

$$S_{dreal}(k)=S_{dreal,n-1}(k)+s_{dreal}(n)\cos(2\pi nk/M)-s_{dreal}(n-M)\cos(2\pi(n-M)k/M)$$

or simplified:

$$s_{dreal,n}(k)=s_{dreal,n-1}(k)+(s_{dreal}(n)-s_{dreal}(n-M))\cos(2nk/M) \tag{1.3a}$$

and $$S_{dimag,n}(k)=S_{dimag,n-1}(k)-s_{dreal}(n)\sin(2\pi nk/M)+s_{dreal}(n-M)\sin(2\pi(n-M)n/M)$$

or simplified:

$$S_{dimag,n}(k)=S_{dimag,n-1}(k)+(s_{dreal}(n-M)-s_{dreal}(n))\sin(2\pi nk/M) \quad (1.3b)$$

The inverse Fourier transformation is the reversing operation to the Fourier transformation and thus very similar.

Inverse Fourier transformation for continuous analog signals:

$$s(t)=\int_{-\infty}^{+\infty} S(f)e^{i2\pi ft}df \quad (1.4)$$

The DFT form for sampled digital signals:

$$s_d(n)=\frac{2}{M}\sum_{k=0}^{M/2-1} S_d(k)e^{i2\pi nk/M} \quad (1.5)$$

The DFT form in Euler's representation:

$$s_d(n)=\frac{2}{M}\sum_{k=0}^{M/2-1} S_d(k)(\cos(2\pi nk/M)+i\sin(2\pi nk/M)) \quad 0\le n<M$$

or split into real and imaginary parts of the inverse Discrete Cosine Transformation (iDCT):

$$s_{dreal}(n)=\frac{2}{M}\sum_{k=0}^{M/2-1} S_{dreal}(k)\cos(2\pi nk/M)-S_{dimag}(k)\sin(2\pi nk/M) \quad (1.6a)$$

$$s_{dimag}(n)=\frac{2}{M}\sum_{k=0}^{M/2-1} S_{dimag}(k)\cos(2\pi nk/M)+S_{dreal}(k)\sin(2\pi nk/M) \quad (1.6b)$$

where $S_{dimag}(n)$ is 0 for all n and therefore not important, as already described earlier.

With the new equations (1.3a) and (1.3b) it is possible to get at every signal sample the complete Fourier spectrum, which can then be inversely transformed by equation (1.6a) without any significant (or at least with a well defined) delay.

As shown in the preferred embodiments and evaluated by circuit analysis, the novel circuits and methods provide an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. An apparatus, realizing an electronic system for a Delay Free Noise Suppression operating on analog electric input signals from a sound sensor as physical input device and delivering analog electric output signals to a sound actor as physical output device, hereby digitally processing noisy sound signals and especially noisy speech signals, comprising:

a first circuit block, wherein said electric input signal as analog input signal x(t), representing a noise polluted sound signal in time t, is continuously converted into a digital input data stream x(n) of noisy sound samples, with n as running counter index;

a second circuit block containing a digital signal processing system processing said digital data stream x(n) of noisy sound samples using a method for 'delay free' noise suppression or noise cancelation for speech signals with Sample-Wise Discrete Cosine Transformation DCT and Spectral Minimum Detection SMD with Noise Gain Factors NGF producing a digital output data stream s(n), said method comprising:

a Sample-Wise Discrete Cosine Transformation algorithm part a Spectral Minimum Detection SMD with Noise Gain Factors NGF algorithm part an Inverse Sample-Wise Discrete Cosine Transformation algorithm part; and a third circuit block, reconverting back said processed digital output data stream s(n) of noise canceled sound samples, representing a noise canceled sound signal, into an analog output signal s(t), which is, in form of an electric signal a noise free sound or speech output signal for said sound actor.

2. The apparatus, according to claim 1 where, in said Sample-Wise Discrete Cosine Transformation algorithm part out of said sound sample x(n) the real parts of the Fourier spectra X(0) . . . X(M-1) are calculated using as Formula Re for the transformation the following recursive Equation $$S_{dreal,n}(k)=S_{dreal,n-1}(k)+(s_{dreal}(n)-s_{dreal}(n-M))\cos(2\pi nk/M) \quad \text{Re:}$$

and further the imaginary parts of the Fourier spectra X(0) . . . X(M-1) are calculated using as Formula Im for the transformation the following recursive Equation $$S_{dimag,n}(k)=S_{dimag,n-1}(k)+(s_{dreal}(n-M)-s_{dreal}(n))\sin(2\pi nk/M) \quad \text{Im:}$$

where, in the mathematical expressions the variables s & S, generic for signal, have to be replaced by x & X respectively, whereby d denotes the application of a discrete Fourier transform algorithm with n as a running counter index and frequency number k used as its running summation index and representing the discrete resulting frequency lines for the frequency band observed.

3. The apparatus, according to claim 1 where, in said Spectral Minimum Detection SMD with Noise Gain Factors NGF algorithm part out of said incoming data stream x(n) the Fourier spectra consisting of a set of M data words X(0) to X(M-1) are transformed into the noise canceled outgoing data stream of Fourier spectra, consisting of an according set of M data words S(0) to S(M-1) with S(n) =N(n)*X(n), where N(n) are said Noise Gain Factors NGF calculated within a time frame determined by said set of M incoming samples x(n), and whereby these NGF values are written as N(n&(M-1)), where the symbolic argument n&(M-1) signifies a particular value, each being selected at least once from within said set of M samples according to an 'n modulo M' rule with M being a power of 2 and are thus delivering a noise free set of M output signal values s(n) without any significant delay i.e. within said time frame defined by said set of M data of said incoming data stream x(n).

4. The apparatus, according to claim 1 where, in said Spectral Minimum Detection SMD with Noise Gain Factors NGF algorithm part out of said incoming data stream x(n) the Fourier spectra, consisting of M data words X(0) to X(M-1) and counted by frequency number k are transformed into the noise canceled outgoing data stream of Fourier spectra, consisting of M data words S(0) to S(M-1) with S(n) =X(n)−$X_{min}$ (n) =N(n)*X(n), where N(n) are said Noise Gain Factors NGF calculated according to N(n) =1.0−$X_{min}$(n)/X(n) * Filter Strength for all X(n)!=0, whereby $X_{min}$ is an estimation of a noise floor, as evaluated with the help of said Spectral Minimum Detection SMD algorithm and an added Filter Strength factor with values between 0.0 (no filtering at all) and 1.0 (maximum filter strength) accounts for deviations from a standard rule and where said Filter Strength value can be chosen as a constant or can be dynamically varied by using a nonlinear function between Filter Strength and averaged Noise Gain Factors N(0) . . . N(M-1).

5. The apparatus, according to claim 1 wherein said Inverse Sample-Wise Discrete Cosine Transformation algorithm part transforms the entity of all M noise reduced spectrum bands S(0) . . . S(M-1) into said sound sample s(n) of said noise free output signal, using as Formula Inv for the transformation, whereby only the real signal part $S_{dreal}$(n) is needed, the following Equation Inv:

$$s_{dreal}(n) = \frac{2}{M}\sum_{k=0}^{M/2-1} S_{dreal}(k)\cos(2\pi nk/M) - S_{dimag}(k)\sin(2\pi nk/M),$$

where k is a frequency number used as summation index and n is a running counter index.

6. A circuit, realizing within an electronic system for a 'Delay Free Noise Suppression' a noise suppression method based upon Sample-Wise Discrete Cosine Transformation ~~(DCT)~~ and Spectral Minimum Detection ~~(SMD)~~ with Noise Gain Factors ~~(NGF)~~ algorithms, hereby digitally processing electric sound signals or especially electric speech signals from a sound sensor as physical input device, whereby an electric noisy sound or speech input signal is represented as a series of continuously digitized words of sound sample data, thus delivering a data stream x(n) (n being the running counter index)-, comprising:

a circuit block, named Sample-Wise Discrete Cosine Transformation unit, comprising a serial data input line and a set of M parallel data output lines, receiving said data stream of sound samples x(n), on said serial data input line, for the according Sample-Wise Discrete Cosine Transformation DCT calculation step of said algorithm, resulting in M data words X(0) to X(M-1), describing the spectrum of said sound sample x(n);

a circuit block, named Digital Signal Processing DSP System for Noise Suppression with Spectral Minimum Detection SMD with Noise Gain Factors NGF comprising a digital signal processor system implementing a noise suppression algorithm, whereby said incoming data stream of M data words X(0) to X(M-1) is transformed into a noise canceled outgoing data stream of M data words S(0) to S(M-1) with S(n) =X(n)−$X_{min}$(n)= N(n)*X(n), where N(n) are said Noise Gain Factors NGF calculated according to N(n) =1.0−$X_{min}$(n)/X(n) * Filter Strength for all X(n)!=0, whereby $X_{min}$ is an estimation of a noise floor, as evaluated with the help of said Spectral Minimum Detection SMD algorithm and an added Filter Strength factor with values between 0.0 (no filtering at all) and 1.0 (maximum filter strength) accounts for deviations from a standard rule and where said Filter Strength value can be chosen as a constant or can be dynamically varied by using a nonlinear function between the Filter Strength and the averaged Noise Gain Factors N(0) . . . N(M-1); and a circuit block comprising a set of parallel data input lines and a serial data output line, named Inverse Sample-Wise Discrete Cosine Transformation unit, which reversely transforms said M noise canceled data values S(0) to S(M-1) back into a noise canceled sound or speech signal s(n), ready for delivering a noise free electric sound or speech output signal to a sound actor as physical output device.

7. The circuit according to claim 6 wherein said Sample-Wise Discrete Cosine Transformation unit calculates out of said sound sample x(n) the real parts of the Fourier spectra X(0) . . . X(M-1) using as Formula Re for the transformation the following recursive Equation $$S_{dreal,n}(k)=S_{dreal,n-1}(k)+(s_{dreal}(n)-s_{dreal}(n-M))\cos(2\pi nk/M) \quad \text{Re:}$$

and further calculates the imaginary parts of the Fourier spectra X(0) . . . X(M-1) using as Formula Im for the transformation the following recursive Equation $$S_{dimag,n}(k)=S_{dimag,n-1}(k)+(s_{dreal}(n-M)-s_{dreal}(n))\sin(2\pi nk/M) \quad \text{Im:}$$

where, in the mathematical expression, the variables s & S, generic for signal, have to be replaced by x & X respectively, whereby d denotes the application of a discrete Fourier transform algorithm with k as frequency numbers and used as summation index representing the discrete resulting frequency lines for the frequency band observed and n being a running counter index.

8. The circuit according to claim 6 wherein said Sample-Wise Discrete Cosine Transformation unit additionally performs a Hann window filtering in the frequency domain.

9. The circuit according to claim 6 wherein said Digital Signal Processing System DSP for Noise Suppression with Spectral Minimum Detection SMD with Noise Gain Factors NGF unit is implemented using an integrated circuit.

10. The circuit according to claim 9 wherein said integrated circuit for said Digital Signal Processing System DSP for Noise Suppression with Spectral Minimum Detection SMD with Noise Gain Factors NGF unit is an integrated Digital Signal Processor circuit.

11. The circuit according to claim 9 wherein said integrated circuit for said Digital Signal Processing System DSP for Noise Suppression with Spectral Minimum Detection SMD with Noise Gain Factors NGF unit is implemented using Application Specific Integrated Circuits.

12. The circuit according to claim 6 wherein said Inverse Sample-Wise Discrete Cosine Transformation unit transforms the entity of all M noise reduced spectrum bands S(0) . . . S(M-1) into said sound sample s(n) of said noise free output signal, using as Formula Inv for the transformation, whereby only the real signal part $S_{dreal}$(n) is needed, the following Equation Inv:

$$s_{dreal}(n) = \frac{2}{M}\sum_{k=0}^{M/2-1} S_{dreal}(k)\cos(2\pi nk/M) - S_{dimag}(k)\sin(2\pi nk/M),$$

where k is a frequency number used as summation index and n is a running counter index.

13. The circuit according to claim 6 wherein said Digital Signal Processing System DSP for Noise Suppression with Spectral Minimum Detection SMD with Noise Gain Factors NGF unit is implemented using integrated circuit technologies.

14. The circuit according to claim 6 wherein said integrated circuit for said Digital Signal Processing System DSP for Noise Suppression with Spectral Minimum Detection SMD with Noise Gain Factors NGF unit is implemented using integrated Digital Signal Processor circuits.

15. The circuit according to claim 6 wherein said integrated circuit for said Digital Signal Processing System DSP for Noise Suppression with Spectral Minimum Detection SMD with Noise Gain Factors NGF unit is implemented using Application Specific Integrated Circuits.

16. A circuit, realizing within an electronic system for a 'Delay Free Noise Suppression' a noise suppression method based upon Sample-Wise Discrete Cosine Transformation DCT and Spectral Minimum Detection SMD with Noise Gain Factors NGF algorithms, hereby digitally processing electric sound signals or especially electric speech signals from a sound sensor as physical input device, where a noisy electric sound or speech input signal is represented as a series of continuously digitized words of sound sample data, thus delivering a data stream x(n) (n being the counting index), comprising:

a circuit block, named Sample-Wise Discrete Cosine Transformation unit, comprising a serial data input line and a set of M parallel data output lines, receiving a data stream of sound samples x(n), on said serial data input line, for an according Sample-Wise Discrete Cosine Transformation DCT calculation step of said algorithm, resulting in M data words X(0) to X(M-1), describing the spectrum of a sound sample x(n);

a circuit block, named Multiplexer unit, comprising a set of parallel data input lines and another set of parallel data output lines and also a serial data output line, whereby said set of parallel data input lines connects to said Sample-Wise Discrete Cosine Transformation unit, and said set of parallel data output lines connects to a consecutively defined set of Multipliers, and said serial data output line connects to a consecutively defined Minimum Detection unit;

a circuit block, named Noise Canceling Multiplier unit, comprising of a set of Multipliers and a Noise Canceling Multiplier NCM Table and serving as a central processing block for said algorithm thereby calculating M noise canceled data values S(0) to S(M-1) with the help of consecutively evaluated Noise Gain Factor NGF values, possessing a set of parallel data input lines and a set of parallel data output lines as well as a serial data input line and a serial data output line, whereby said set of parallel data input lines connects to said Multiplexer unit and said set of parallel data output lines connects to a consecutively defined Inverse Sample-Wise Discrete Cosine Transformation unit, and whereby said serial data input line connects to a consecutively defined Synchronous Signal Detection unit and said serial data output line connects to a consecutively defined Noise Gain Factor Calculation unit;

a circuit block, named Minimum Detection unit, comprising a serial data input line and a serial data output line, whereby said serial data input line connects to said Multiplexer unit and said serial data output line connects to said Noise Gain Factor Calculation unit;

a circuit block, named Noise Gain Factor Calculation unit, responsible for the calculations for said M Noise Gain Factor NGF values N(0) to N(M-1), comprising a total of four serial data input lines and a serial data output line, whereby a first serial data input line connects to said Noise Canceling Multiplier unit, and a second serial data input line connects to said Minimum Detection unit, and a third serial data input line connects to a consecutively defined Average Calculation unit, and a fourth serial data input line connects to an optional and separately furnished Filter Strength value signal and whereby said serial data output line connects to said Synchronous Signal Detection unit;

a circuit block, named Average Calculation unit, comprising a serial data input line and a serial data output line whereby said serial data input line connects to said Synchronous Signal Detection unit and said serial data output line connects to said Noise Gain Factor Calculation unit;

a circuit block, named Synchronous Signal Detection unit, comprising a serial data input line and a serial data output line whereby said serial data input line connects to said Noise Gain Factor Calculation unit and said serial data output line connects to said Average Calculation unit as well as said Noise Canceling Multiplier unit; and finally a circuit block comprising a set of parallel data input lines and a serial data output line, named Inverse Sample-Wise Discrete Cosine Transformation unit, which reversely transforms back said M noise canceled data values S(0) to S(M-1) into a noise canceled electric sound or speech signal s(n) for a sound actor as physical output device.

17. The circuit according to claim 16 wherein said Sample-Wise Discrete Cosine Transformation unit calculates from said sound sample x(n) the real parts of the M Fourier spectra X(0) . . . X(M-1) using as Formula Re for the transformation the following recursive Equation $$S_{dreal,n}(k)=S_{dreal,n-1}(k)+(s_{dreal}(n)-s_{dreal}(n-M))\cos(2\pi nk/M) \quad \text{Re:}$$

and further calculates the imaginary parts of the M Fourier spectra X(0) X(M-1) using as Formula Im for the transformation the following recursive Equation $$S_{dimag,n}(k)=S_{dimag,n-1}(k)+(s_{dreal}(n-M)-s_{dreal}(n))\sin(2\pi nk/M) \quad \text{Im:}$$

where, in the mathematical expression the variables s & S, generic for signal, have to be replaced by x & X respectively, whereby d denotes the application of a discrete Fourier transform algorithm with k as frequency number and used as summation index representing the discrete resulting frequency lines for the frequency band observed and n being a running counter index.

18. The circuit according to claim 16 wherein said Sample-Wise Discrete Cosine Transformation unit additionally performs a Hann window filtering in the frequency domain.

19. The circuit according to claim 16 wherein said Multiplexer unit receives said M spectrum data words X(0) to X(M-1) and then delivers said data via said Multiplexer serially clocked into said Minimum Detection unit as X(n&(M-1)) and in parallel into said M Multipliers of said Noise Canceling Multiplier unit as X(0) to X(M-1).

20. The circuit according to claim 16 wherein said Noise Canceling Multiplier NCM Table is having one input line for said serial input data stream of selected values of said Noise Gain Factors NGF N(n&(M-1)) from said Synchronous Signal Detection unit and one output line for said serial output data stream of selected values of said Noise Gain Factors NGF N(n&(M-1)) for said Noise Gain Factor Calculation unit and also a set of M output lines for said Noise Gain Factors NGF N(0) to N(M-1) fed to said set of M Multipliers.

21. The circuit according to claim 16 wherein said set of M Multipliers is having a set of M input data lines for said M spectrum data words X(0) to X(M-1) and another set of M input data lines for said Noise Gain Factors NGF N(0) to N(M-1) and is also having a set of M output data lines for the processed M spectrum data words S(0) to S(M-1).

22. The circuit according to claim 16 wherein said Noise Canceling Multiplier unit receives said series of NGF values N(n&(M-1)) and switches said values through said Noise Canceling Multiplier Table unit as multiplication factors N(0) to N(M-1) into said M Multipliers of said Noise Canceling Multiplier unit, and there multiplies said also received M spectrum data words X(0) to X(M-1) with said NGF values N(0) to N(M-1), such generating said noise canceled output data values S(0) to S(M-1).

23. The circuit according to claim 16 wherein said Minimum Detection unit processes said serial spectrum data words X(n&(M-1)) in order to evaluate a minimum value $X_{min}$(n&(M 1)) for an according signal sample x(n) during an appropriately chosen period of time and feeding said minimum value $X_{min}$(n&(M1)) to said Noise Gain Factor Calculation unit.

24. The circuit according to claim 16 wherein said Noise Gain Factor Calculation unit receives firstly an input value $X_{min}$(n&(M-1)) from said Minimum Detection unit, secondly a Filter Strength value, which is separately evaluated and furnished, thirdly an average Noise Gain Factor NGF value furnished from said Average Calculation unit and fourthly a series of previous NGF values N(n&(M-1)), clocked in from said Noise Canceling Multiplier Table unit, part of the Noise Canceling Multiplier unit, then calculates out of these four input signals a new series of NGF values N(n&(M-1)) and feeds said new values via said Synchronous Signal Detection unit into said Noise Canceling Multiplier Table of the Noise Canceling Multiplier unit and also feeds said series of NGF values N(n&(M-1)) into said Average Calculation unit.

25. The circuit according to claim 16 wherein said Average Calculation unit receives said Noise Gain Factors NGFvalues N(0) . . . N(M-1) as selected data according to N(n&(M-1)) from said Synchronous Signal Detection" unit, then calculates the average from a certain number of said Noise Gain Factors N(0) . . . N(M-1) as a new data series of said Noise Gain Factors N(0) . . . N(M-1) and then delivers said data into said Noise Gain Factor Calculation unit as N (n&(M-1)).

26. The circuit according to claim 16 wherein said Synchronous Signal Detection unit receives said serial data stream of selected values N(n&(M-1)) from said Noise Gain Factor Calculation unit, thereby detecting and appropriately processing irregular data into a new serial data stream of selected values N(n&(M-1)) and then delivers said new serial data stream of selected values N(n&(M-1)) into said Noise Canceling Multiplier Table unit as N(n&(M-1)) and to said Average Calculation unit.

27. The circuit according to claim 16 wherein said Inverse Sample-Wise Discrete Cosine Transformation unit receives said noise canceled data values S(0) to S(M-1), and then reversely transforms the entity of all of said received M noise reduced spectrum bands S(0) . . . S(M-1) into said sound sample s(n) of said noise free output signal, using as Formula Inv for the transformation, whereby only the real signal part $S_{dreal}$(n) is needed, the following Equation Inv:

$$s_{dreal}(n) = \frac{2}{M}\sum_{k=0}^{M/2-1} S_{dreal}(k)\cos(2\pi nk/M) - S_{dimag}(k)\sin(2\pi nk/M)$$

where n is a running counter index and k is a frequency number used as summation index.

28. The circuit according to claim 16 implemented using integrated circuit technologies.

29. The circuit according to claim 16 implemented using integrated Digital Signal Processor circuits.

30. The circuit according to claim 16 implemented using Application Specific Integrated Circuits.

31. A method, describing in detailed steps an algorithm and its electronic implementation units for a 'Delay Free Noise Suppression', where said method steps are dealing with analog electric input sound or especially noisy speech signals from a sound sensor as physical input device, transformed into both, analog time signals x(t) and sampled signals x(n), their corresponding M spectrum data words X(0) to X(M-1), and Noise Gain Factor NGF values N(n&(M-1)), and where said symbolic argument n&(M-1) signifies a particular value, each being selected at least once from a set of M samples according to an 'n modulo M' rule with M being a power of 2 and where said method steps are further dealing with respective output spectrum data of M spectral data words S(0) to S(M-1), as provided by the algorithm of said method and a noise canceled output signal s(t), thereby n being a running counter index, and t signifying time, comprising:

preparing for the processing of received noisy speech input signals x(t), delivered from an A/D converter, representing a series of digitized words of sound sample data in form of an input data stream x(n);

receiving data stream sample n of sound samples x(n) for an according, consecutively described Sample-Wise Discrete Fourier Transformation calculation step;

calculating the spectrum of sound sample x(n), exemplified for a single sample x(n), performed in a Sample-Wise Discrete Cosine Transformation unit, resulting in M parallel data words X(0) to X(M-1), describing the spectrum of sound signal sample x(n);

performing optionally a Hann windowing in the frequency domain on said M spectrum data words X(0) to X(M-1);

delivering said M spectrum data words X(0) to X(M-1) via a Multiplexer unit in parallel into M Multipliers, part of a Noise Canceling Multiplier unit, clocking serially in a data stream X(n&(M-1)) into a Minimum Detection unit;

processing said M serial spectrum data words X(n&(M-1)) in order to evaluate a minimum spectrum value $X_{min}$(n&(M-1)) for said sound signal sample x(n);

feeding said minimum spectrum value $X_{min}$(n&(M-1)) into a Noise Gain Factor Calculation unit;

receiving said input values in said Noise Gain Factor Calculation unit, comprising a total of four inputs: input #1 for minimum spectrum value $X_{min}$(n&(M-1 )), input #2 for a Filter Strength value, separately evaluated and furnished, input #3 for an average Noise Gain Factor NGF value furnished from an Average Calculation unit, and input #4 for a series of previous NGF values N(n&(M-1)), clocked in from a Noise Canceling Multiplier Table unit, part of said Noise Canceling Multiplier unit;

calculating in said Noise Gain Factor Calculation unit out of the four input signals a new series of NGF values N(n&(M-1));

feeding said new series of NGF values N(n&(M-1)) via a Synchronous Signal Detection unit into said Noise Canceling Multiplier Table unit of said Noise Canceling Multiplier unit;

feeding also said new series of NGF values N(n&(M-1)) into said Average Calculation unit as input values;

switching through said new series of NGF values N(n&(M-1)) to said Noise Canceling Multiplier Table unit as multiplication factors N(0) to N(M-1) into said M Multipliers of said Noise Canceling Multiplier unit;

multiplying said new series of NGF values N(n&(M-1)) with said according spectrum data words X(0) to X(M-1) of said noisy speech input signal and thus generating with said multiplication process of said spectrum data words X(0) to X(M-1) with said NGF values N(0) to N(M-1) M new, noise canceled data values S(0) to S(M-1);

transforming reversely in said Inverse Sample-Wise Discrete Cosine Transformation unit out of said M new, noise canceled data values S(0) to S(M-1) a noise canceled speech signal s(n);

preparing for the transmission of said noise canceled speech output signals, represented as a series of digitized words of sound sample data, a data stream s(n), into a D/A converter for the final conversion into a noise free electric speech signal s(t) for a sound actor as physical output device.

32. A method, describing in detailed steps an algorithm and its electronic implementation units for a 'Delay Free Noise Suppression', whereby a division into three parts: a Sample-Wise Discrete Cosine Transformation part, a Spectral Minimum Detection SMD with Noise Gain Factors NGF part, and an Inverse Sample-Wise Discrete Cosine Transformation part is used and where said method steps are dealing with analog electric input of noisy sound or especially noisy speech signals from a sound sensor as physical input device, transformed into both, analog time signals x(t) and sampled signals x(n), their corresponding M spectrum data words X(0) to X(M-1), and Noise Gain Factor NGF values N(n&(M-1)), and where the symbolic argument n&(M-1) signifies a particular value, each selected at least once from a set of M samples according to an 'n modulo' rule with M being a power of 2 and where said method steps are further dealing with the respective output spectrum data of M spectral data words S(0) to S(M-1), as provided by the algorithm of said method and a noise canceled output signal s(t), thereby n being a running counter index, and t signifying time, comprising:

providing a means for a Sample-Wise Discrete Cosine Transformation, wherein according to the Theory of the Sample-Wise Discrete Cosine Transformation DCT a continuous stream of sound samples x(n) is transformed into its Fourier spectrum X, represented by M frequency bands X(0) . . . X(M-1), and evaluated for every sample and wherein the Formulas Re and Im—as given and defined in the following two steps for the real and imaginary parts correspondingly —are used for the transformation of x(n) into X(0) . . . X(M-1), the X thereby split into their real and their imaginary parts, $X_{real}$ and $X_{imag}$, n thereby being the running counter index of a continuous input stream of sound samples and M the number of frequency bands observed;

transforming within said means for said Sample-Wise Discrete Cosine Transformation signal sample x(n) into the real parts of the Fourier spectra X(0) . . . X(M-1) using as Formula Re for the transformation the following recursive Equation $$S_{dreal,n}(k)=S_{dreal,n-1}(k)+(s_{dreal}(n)-s_{dreal}(n-M))\cos(2\pi nk/M) \quad \text{Re:}$$

where, in the mathematical expression the variables s & S, generic for signal, have to be replaced by x & X respectively, whereby d denotes the application of a discrete Fourier transform algorithm with k as frequency numbers and used as summation index representing the discrete resulting frequency lines for the frequency band observed and n being a running counter index;

transforming also within said means for a Sample-Wise Discrete Cosine Transformation signal sample x(n) into the imaginary parts of the Fourier spectra X(0) . . . X(M-1) using as Formula Im for the transformation the following recursive Equation $$S_{dimag,n}(k)=S_{dimag,n-1}(k)+(s_{dreal}(n-M)-s_{dreal}(n))\sin(2\pi nk/M) \quad \text{Im:}$$

where, in the mathematical expression the variables s & S, generic for signal, have to be replaced by x & X respectively, whereby d denotes the application of a discrete Fourier transform algorithm with k as frequency numbers and used as summation index representing the discrete resulting frequency lines for the frequency band observed and n being a running counter index;

providing a means for a Multiplexer unit, where said multiplexer selects one or more of said M frequency bands X(0) . . . X(M-1) for each of said incoming sound samples x(n) and provide this as part of a means for a Spectral Minimum Detection SMD with Noise Gain Factors NGF;

providing a means for a Minimum Detection unit, detecting the absolute minimum of the amplitude value of X(n&(M-1)) for each frequency band for a period of a few hundred milliseconds in the past; also as part of said means for Spectral Minimum Detection SMD with Noise Gain Factors NGF;

comparing within said Minimum Detection unit at least two values for each frequency band using a history buffer, where each value of said history buffer contains the minimum for a certain section of time and where the absolute minimum for the whole past period is the absolute minimum of all values for each frequency;

detecting for said past period within said Minimum Detection unit said absolute minimum of said amplitude values using for the length of the whole period values between 100 and 1000 ms, depending on the application;

sending the values X(n&(M-1)) from said Multiplexer unit to said Minimum Detection unit, whereby the order of which is not important, but every frequency has to be selected at least once within each set of M incoming samples;

forming the average $X_{min}$(n&(M-1)) in said Minimum Detection unit for a short time compared to the length of the period and for each value X(n&(M-1)) coming from said Multiplexer unit;

providing a means for a Noise Gain Factor Calculation unit for processing a noise reduction algorithm, which defines an $X_{min}$(n) value as the energy of the noise floor and which has to be subtracted from the noisy speech signal; this also being a part of said means for Spectral Minimum Detection SMD with Noise Gain Factors NGF;

sending from said Minimum Detection unit a detected absolute minimum value $X_{min}$(n&(M-1)) to said Noise Gain Factor Calculation unit;

calculating within said Noise Gain Factor Calculation unit a Noise Gain factor N(n) according to N(n) =1.0−$X_{min}$(n)/X(n) for all X(n)!=0, which is multiplied to the Fourier components X(0) . . . X(M-1) instead of $X_{min}$(n) being subtracted from X(n);

adding within said Noise Gain Factor Calculation unit an optional Filter Strength factor with values between 0.0

(no filtering at all) and 1.0 (maximum filter strength) to the N(n) calculation formula, so that $N(n)=1.0-X_{min}(n)/X(n)$ * Filter Strength for all X(n)!=0, where $X_{min}$ is an estimation of the noise floor;

providing a means for an Average Calculation unit, wherein the average about all of said M Noise Gain Factors N(n) =N(0) . . . N(M-1) is calculated, as part also of said means for "Spectral Minimum Detection SMD with Noise Gain Factors NGF";

forming an average for said Noise Gain Factor N(n) within said Average Calculation unit;

adjusting dynamically said optional Filter Strength value within said Noise Gain Factor Calculation unit using said average value N(n) as calculated by said Average Calculation unit;

choosing said optional Filter Strength value as a constant or a dynamically varied variable by using a nonlinear function between the filter strength and the averaged Noise Gain Factors N(0) . . . N(M-1) coming from said Average Calculation unit;

providing a means for said Noise Canceling Multiplier unit, wherein said Noise Canceling Multiplier Table means is contained, buffering all Noise Gain Factors calculated during one period additionally to according internal serial/parallel converters and where said Noise Canceling Multiplier unit is responsible for the subtraction of the noise by multiplying each Noise Gain Factor N(n) with the corresponding X(n), using M internal multipliers, delivering as result M wanted noise reduced speech signal spectrum bands S(n)=S(0) . . . S(M-1) and this also as part of said means for Spectral Minimum Detection SMD with Noise Gain Factors NGF;

providing a means for a Synchronous Signal Detection unit as part of said means for Spectral Minimum Detection SMD with Noise Gain Factors NGF, using the property of the Noise Gain Factors N(0) . . . N(M-1), that if the neighbor frequencies reduce the speech signal, the actual observed and treated frequency is also reduced by the noisy speech signaldetecting irregular situations within said Synchronous Signal Detection unit by comparing the neighbor frequencies and reduce the effect of such situations, where the algorithm detects in a noise floor unwanted modulation frequencies of speech, which could lead to irregular musical tones, by reducing the multiplication factor of the corresponding Noise Canceling Multiplier to make sure that no musical tones appear;

sending said averaged Noise Gain Factor N(n), delivered by said Noise Gain Factor Calculation unit to said Synchronous Signal Detection unit and calculating a new Noise Gain Factor N(n&(M-1)), which replaces the old value in the buffer of said Noise Canceling Multiplier unit and ensure, that said new value is sent additionally to the Average Calculation unit;

storing intermediately said Noise Gain Factor NGF values within said Noise Canceling Multiplier unit in said means for a Noise Canceling Multiplier Table, which contains registers for all processed NGF values delivered from said Synchronous Signal Detection unit, and which is used as an intermediate storage area for said Noise Gain Factor Calculation unit and where the serial/parallel converter handles an allocation of sequentially provided NGF values to the appropriate multipliers of said Noise Canceling Multiplier unit;

amplifying within or in conjunction with said means for a Noise Canceling Multiplier the speech signal to compensate for the energy loss resulting from the subtraction of the noise energy in order to reach a virtually noise canceled speech signal output;

providing a means for an Inverse Sample-Wise Discrete Cosine Transformation unit, wherein the last step of the calculation, an inverse Fourier transformation is done according to the Theory of the Sample-Wise Discrete Cosine Transformation;

changing within or in conjunction with said unit for an Inverse Sample-Wise Discrete Cosine Transformation the phases of each frequency value in order to reach a definable delay in the output signal and therefore making it possible to get the same processing delay for every sampling rate;

transforming within said Inverse Sample-Wise Discrete Cosine Transformation unit M noise reduced spectrum bands S(0) . . . S(M-1) coming from said Noise Canceling Multiplier unit into a next sample s(n) of noise free speech signal sample as output, obeying for this calculation to the Formula of Equation Inv, given and defined in the following step;

processing within said Inverse Sample-Wise Discrete Cosine Transformation unit the transformation of the entity of all M noise reduced spectrum bands S(0) . . . S(M-1) into said sample s(n) of said noise free output signal, using as Formula Inv for said transformation, whereby only the real signal part $s_{dreal}(n)$ is needed, the following Equation Inv:

$$s_{dreal}(n) = \frac{2}{M}\sum_{k=0}^{M/2-1} S_{dreal}(k)\cos(2\pi nk/M) - S_{dimag}(k)\sin(2\pi nk/M)$$

thus summing up all the spectral frequency lines designated by frequency number k running from 0 to (M/2)−1, considering said discretely calculated real and imaginary components $S_{dreal}$ and $S_{dimag}$ of the complex spectrum bands S;

supplying said continuous stream of noise canceled digital output signal samples s(n) ready for its conversion into a noise free electric analog sound or speech signal s(t) as a function of time t for a sound actor as physical output device by recurring the appropriate processing loop for the complete algorithm from its beginning.

* * * * *